US005326740A

United States Patent [19]

Kamosaki et al.

[11] Patent Number: 5,326,740

[45] Date of Patent: Jul. 5, 1994

[54] THERMAL TRANSFER IMAGE-RECEIVING MATERIAL

[75] Inventors: Tetsu Kamosaki; Mitsugu Tanaka; Masakazu Yoneyama, all of Kanagawa, Japan

[73] Assignee: Fuji Photo Film Co., Ltd., Kanagawa, Japan

[21] Appl. No.: 960,869

[22] Filed: Oct. 14, 1992

[30] Foreign Application Priority Data

Oct. 18, 1991 [JP] Japan ..... 3-297782
Jun. 11, 1992 [JP] Japan ..... 4-176028

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 4,839,338 6/1989 Marbrow ..... 503/227

*Primary Examiner*—B. Hamilton Hess
*Attorney, Agent, or Firm*—Sughrue, Mion, Zinn, Macpeak & Seas

[57] ABSTRACT

A thermal transfer image-receiving material having an image-receiving layer comprising a thermoplastic resin capable of receiving a dye, on a support, wherein the thermoplastic resin is a polyester having anti-fading groups in at least one of a main chain and a side chain moiety of the molecular structure of the thermoplastic resin and the material has the ability to form an image with a high image density and excellent image storage stability by thermal transfer recording.

18 Claims, No Drawings

THERMAL TRANSFER IMAGE-RECEIVING MATERIAL

FIELD OF THE INVENTION

The present invention relates to a thermal transfer image-receiving material for thermal transfer recording and, in particular, to a thermal transfer image-receiving material capable of forming an image having a high density and having excellent image storage stability.

BACKGROUND OF THE INVENTION

Recently, various information processing systems have been developed in accordance with the rapid evolution of the information industry, and various recording methods and apparatus suitable to the respective information processing systems have been developed and employed.

A thermal transfer recording method is one type of system that has been widely used and this method requires a light-weight, compact, noise-free device having excellent operatability and ease of maintenance and may easily form color images. The thermal transfer recording method may be roughly grouped into two groups. One is a thermofusion type method and the other is a thermomobile type method.

The latter method involves a thermal transfer dye-providing material having a dye-providing layer containing a binder and a thermomobile dye on a support which is laid on a thermal transfer image-receiving material and heated from the side of the support of the dye-providing material to thereby transfer the thermomobile dye to the recording medium (thermal transfer image-receiving material) in accordance with the heated pattern to form a transferred image.

The thermomobile dye used in the thermomobile type method is a dye capable of being transferred from the thermal transfer dye-providing material to the thermal transfer image-receiving material upon sublimation or diffusion in a medium.

However, there are problems which are associated with known methods. For example, the images obtained by conventional thermal transfer image-receiving materials do not have a sufficient image density, and/or the storage stability of the images, especially the light-fastness, is not sufficient. Therefore, the hue of the images varies or the image density of the images lowers when the images are exposed to sun light or fluorescent light.

A means of improving the storage stability of images by adding an anti-fading agent to an image-receiving layer has been recognized. However, where a low molecular weight compound having a molecular weight of 1000 or less, such as an ordinary anti-fading agent, is added to an image-receiving layer, the transferred thermomobile dye diffuses in the image-receiving layer via the low molecular weight compound so that the storage stability of the formed image is defective. In particular, where the formed image is stored under high temperature conditions, various unfavorable problems of retransferrence of the formed image or blurring of the same occur.

SUMMARY OF THE INVENTION

In accordance with the present invention, since a thermoplastic resin containing anti-fading groups in the molecule is in the image-receiving layer, improvement of the light fastness of the image formed is accomplished without lessening the storage stability thereof under high temperature conditions.

The objects of the present invention are to overcome the above-mentioned problems. Accordingly, the above and other objects and advantages are accomplished by the present invention which provides a novel thermal transfer image-receiving material having an image-receiving layer comprising a thermoplastic resin capable of receiving a dye, on a support, wherein the thermoplastic resin comprises anti-fading groups in at least one of a main chain and a side chain moiety of the molecular structure of the thermoplastic resin. The thermoplastic resin comprising anti-fading groups in the molecular structure is a polyester obtained by polycondensation of monomers represented by formulae (1), (2), (3) and (4) or monomers represented by formulae (1), (2), (5) and (6).

$$HO\text{-}(A_1)\text{-}OH \quad (1)$$

$$B_1OOC\text{-}(A_2)\text{-}COOB_2 \quad (2)$$

$$HO\text{-}(A_3)\text{-}OH \quad (3)$$
$$\quad\quad |$$
$$\quad (L_1\text{-}M_1)_a$$

$$B_3OOC\text{-}(A_4)\text{-}COOB_4 \quad (4)$$
$$\quad\quad |$$
$$\quad (L_2\text{-}M_2)_b$$

$$HO\text{-}(M_3)\text{-}OH \quad (5)$$

$$B_5OOC\text{-}(M_4)\text{-}COOB_6 \quad (6)$$

wherein $A_1$ and $A_2$ each represents a substituted or unsubstituted alkylene, arylene or cycloalkylene group having from 1 to 18 carbon atoms and may be the same or different;

$A_3$ and $A_4$ each represents a substituted or unsubstituted alkylene or arylene group having from 1 to 18 carbon atoms and may be the same or different;

$B_1$, $B_2$, $B_3$, $B_4$, $B_5$ and $B_6$ each represents a hydrogen atom or a substituted or unsubstituted alkyl group having from 1 to 8 carbon atoms and may be the same or different;

$L_1$ and $L_2$ each represents a linking group capable of bonding adjacent groups to each other via a bonding group of ether, ester, amido or urethane and may be the same or different;

a and b each represents 1 or 2 and may be the same or different;

$M_1$ and $M_2$ each represents an anti-fading group of formula (7) and may be the same or different:

(7)

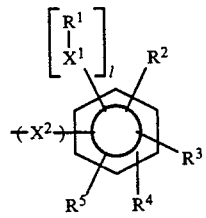

wherein $R_1$ represents a hydrogen atom, or a substituted or unsubstituted alkyl, alkenyl, aryl, heterocyclic or silyl group having from 1 to 21 carbon atoms; and if l is more than 1, the more than one $R^1$'s may be same or different from each other;

$X^1$ represents —O—, —S— or =N—$R^{(1)}$ wherein $R^{(1)}$ is a hydrogen atom or a substituted or unsubstituted alkyl or aryl group having up to 18 carbon atoms; when $X^1$ is —O— and $R^1$ is an alkyl group, then if two adjacent —$OR^1$ groups are present, the two adjacent —$OR^1$ groups may be bonded to each other to form a methylene or ethylene group;

$X^2$ represents a bonding group of ether, ester, amido or urethane;

l represents a number from 1 to 3; and $R^2$, $R^3$, $R^4$ and $R^5$ each represents a hydrogen atom, an organic residue or $[R^1—X^1]$ wherein $R^1$ and $X^1$ having the same meaning as those described above, and may be the same or different; and $M_3$ and $M_4$ each represents an anti-fading group of formula (8) and may be the same or different;

(8)

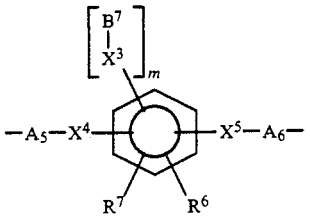

wherein $B_7$ represents a hydrogen atom, or a substituted or unsubstituted alkyl, alkenyl, aryl, heterocyclic or silyl group having from 1 to 18 carbon atoms; and if m is more than 1, the more than one $B_7$'s may be same or different from each other;

m represents 1 or 2;

$X^3$, $X^4$ and $X^5$, which may be the same or different, each represents —O—, —S— or =N—$B^8$ wherein $B^8$ is a hydrogen atom or an alkyl or aryl group having up to 18 carbon atoms;

$A_5$ and $A_6$ each represents a linking group and may be the same or different; and $R^6$ and $R^7$ each represents a hydrogen atom or an organic residue and may be the same or different.

DETAILED DESCRIPTION OF THE INVENTION

Formulae (1) to (8) will be explained in more detail hereunder. In formulae (1) to (8), $A_1$ and $A_2$ each represents a substituted or unsubstituted alkylene, arylene or cycloalkylene group having from 1 to 18 carbon atoms. Examples of the alkylene and cycloalkylene groups of $A_1$ are set forth below.

(9)

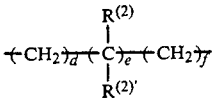

wherein $R^{(2)}$ and $R^{(2)'}$, which may be the same or different, each represents a substituted or unsubstituted alkyl group having from 1 to 6 carbon atoms; and d, e and f, which may be the same or different, each represents a number of from 0 to 20, provided that d+e+f>2.

(10)

wherein $R^{(3)}$ and $R^{(3)'}$, which may be the same or different, each represents a hydrogen atom or a methyl group; and d' represents a number from 1 to 10.

(11)

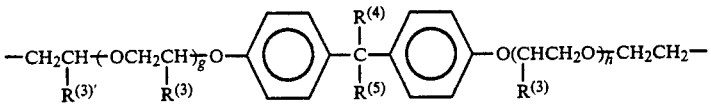

wherein $R^{(3)}$ and $R^{(3)'}$, which may be the same or different, each represents a hydrogen atom or a methyl group; $R^{(4)}$ and $R^{(5)}$, which may be the same or different, each represents a substituted or unsubstituted alkyl group having from 1 to 6 carbon atoms; and g and h, which may be the same or different, each represents a number from 0 to 7.

(12)

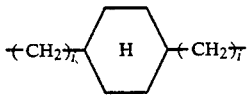

wherein i represents a number from 1 to 6.

Examples of the arylene group of $A_1$ are set forth below.

(13)

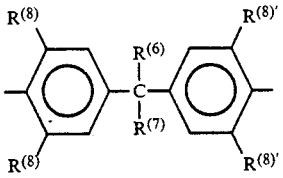

wherein $R^{(6)}$, $R^{(7)}$, $R^{(8)}$ and $R^{(8)'}$, which may be the same or different, each represents a hydrogen atom, or a substituted or unsubstituted alkyl group having from 1 to 6 carbon atoms.

(14)

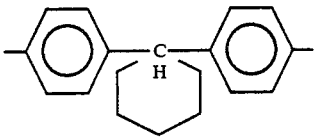

Examples of the alkylene, arylene and cycloalkylene groups of $A_2$ are set forth below.

$$—(CH_2)_j— \quad (15a)$$

where j is a number from 2 to 18;

(15b)

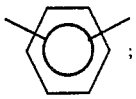

-continued (15c)

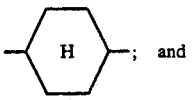

; and (15d)

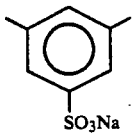

$B_1$, $B_2$, $B_3$, $B_4$, $B_5$ and $B_6$, which may be the same or different, each represents a hydrogen atom, or an alkyl group having from 1 to 8 carbon atoms.

$L_1$ and $L_2$ each represents a linking group cable of bonding adjacent groups via a bonding group of ether, ester, amido, for example, carbonamido, or sulfonamide, or urethane. For instance, examples of $L_1$ and $L_2$ include —COO—, —OOC—, —CONH— and —NH-CO— bonds.

a and b each represents 1 to 2 and may be the same or different.

$M_1$ and $M_2$ each represents an anti-fading group of formula (7) and may be the same or different:

(7)

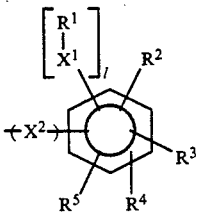

wherein $R^1$ represents a hydrogen atom, or a substituted or unsubstituted alkyl, alkenyl, aryl, heterocyclic or silyl group having from 1 to 21 carbon atoms; and if l is more than 1, the more than one $R^1$'s may be same or different from each other;

$X^1$ represents —O—, —S— or =N—$R^{(1)}$ wherein $R^{(1)}$ is a hydrogen atom or a substituted or unsubstituted alkyl or aryl group having up to 18 carbon atoms; when $X^1$ is —O— and $R^1$ is an alkyl group, then if two adjacent —$OR^1$ groups are present, the two adjacent —$OR^1$ groups may be bonded to each other to form a methylene or ethylene group;

$X^2$ represents a bonding group of ether, ester, amido (for example, carbonamido, sulfonamido) or urethane;

l represents a number from 1 to 3; and $R^2$, $R^3$, $R^4$ and $R^5$ each represents a hydrogen atom, an organic residue or $[R^1—X^1]$ wherein $R^1$ and $X^1$ have the same meaning as those described above, and may be the same or different. The organic residue is, for example, a substituted or unsubstituted alkyl group having from 1 to 8 carbon atoms, or an alkyl group substituted with chlorine or bromine.

$M_3$ and $M_4$ each represents an anti-fading group of formula (8) and may be the same or different:

(8)

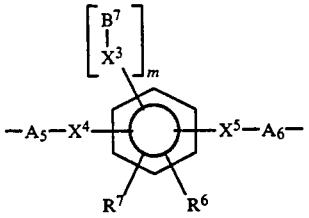

wherein $B^7$ represents a hydrogen atom, or a substituted or unsubstituted alkyl, alkenyl, aryl, heterocyclic or silyl group having from 1 to 18 carbon atoms; and if m is more than 1, the more than one $B^7$'s may be the same as or different from each other;

m represents 1 or 2;

$X^3$, $X^4$ and $X^5$, which may be the same or different, each represents —O—, —S— or =N—$B^8$ wherein $B^8$ is a hydrogen atom or an alkyl or aryl group having up to 18 carbon atoms;

$A_5$ and $A_6$ each represents a linking group (examples of $A_5$ and $A_6$ include an alkylene group having from 2 to 18 carbon atoms) and may be the same or different; and $R^6$ and $R^7$ each represents a hydrogen atom or an organic residue and may be the same or different. Examples of $R^6$ and $R^7$ include a substituted or unsubstituted alkyl group having from 1 to 8 carbon atoms, or an alkyl groups substituted with chlorine or bromine.

Examples of groups composed of ($A_3$) and $L_1$ or ($A_4$) and $L_2$ in which ($A_3$) and $L_1$ or ($A_4$) and $L_2$ bond to each other are set forth below.

Examples of

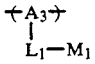

include:

(16)

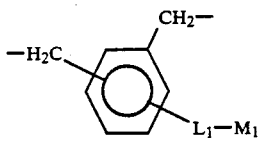

(17)

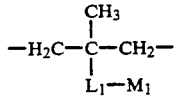

Examples of

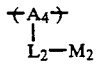

include:

(18)

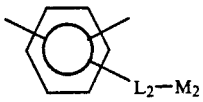

In formulae (16) to (18), $—L_1—M_1$ and $—L_2—M_2$ each represents $—O—R(9)—M_1(M_2)$, $—COOR^{(10)}—M_1(M_2)$, $—CON(R^{(11)})—R^{(12)}—M_1(M_2)$, $—SO_2—N(R^{(11)})—R^{(13)}—M_1(M_2)$, or $—OOCNH—R^{(14)}—M_1(M_2)$; wherein $R^{(9)}$, $R^{(10)}$, $R^{(12)}$, $R^{(13)}$ and $R^{(14)}$, which may be the same or different, each represents a substituted or unsubstituted alkylene group having from 2 to 10 carbon atoms; and $R^{(11)}$ represents a hydrogen atom or an alkyl group having from 1 to 6 carbon atoms.

$M_1$, $M_2$, $M_3$ and $M_4$ can further be represented by anti-fading groups of formulae (19) to (24):

(19)

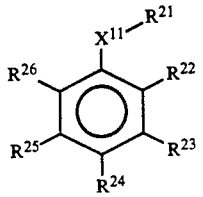

(20)

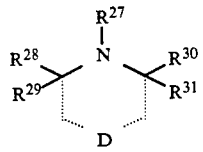

(21)

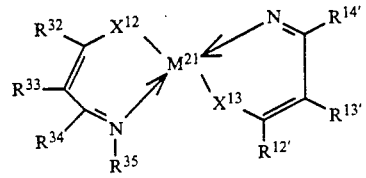

(22)

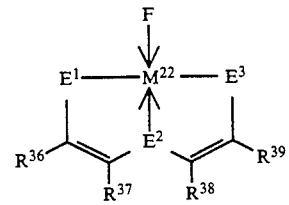

(23)

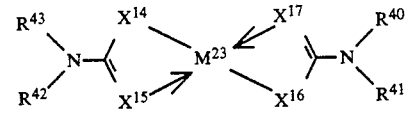

(24)

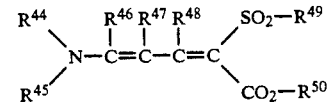

In formulae (19) to (24), $R_{21}$ represents a hydrogen atom, an alkyl group, an alkenyl group, an aryl group, a heterocyclic group, a silyl group or a phosphino group;

$X^{11}$ represents —O—, —S— or $=N—R_{51}$;

$R_{51}$ represents a hydrogen atom, an alkyl group or an aryl group;

$R^{22}$, $R^{23}$, $R^{24}$, $R^{25}$ and $R^{26}$ each represents a hydrogen atom or a non-metallic substituent and may be the same or different;

$R^{27}$, $R^{28}$, $R^{29}$, $R^{30}$ and $R^{31}$ each represents a hydrogen atom, an alkyl group having from 1 to 4 carbon atoms or an aryl group having from 6 to 10 carbon atoms and may be the same or different;

D represents a non-metallic atomic group necessary for forming a 5- to 7-membered ring;

$M^{21}$ and $M_{22}$ each represents copper, cobalt, nickel, palladium or platinum and may be the same or different;

$R^{32}$, $R^{33}$, $R^{34}$, $R^{12'}$, $R^{13'}$ and $R^{14'}$ each represents a hydrogen atom, an alkyl group or an aryl group and may be the same or different;

the adjacent substituents of $R^{32}$ to $R^{34}$ and $R^{12'}$ to $R^{14'}$ may be bonded to form an aromatic ring or a 5- to 8-membered ring;

$R^{35}$ and $R^{15'}$ each represents a hydrogen atom, an alkyl group, an aryl group, a hydroxyl group, an alkoxy group or an aryloxy group and may be the same or different;

$X^{12}$ and $X^{13}$ each represents —O— or —S— and may be the same or different;

$R^{35}$ may be bonded to $R^{15'}$;

$E^1$ and $E^3$ each represents an oxygen atom, a sulfur atom, a hydroxyl group, a mercapto group, an alkoxy group, an alkylthio group or $—N(R^{52})(R^{53})$ and may be the same or different;

$R^{52}$ and $R^{53}$ each represents a hydrogen atom, an alkyl group, an aryl group or a hydroxyl group and may be the same or different;

$E^2$ represents —O—, —S— or $=N—R_{54}$;

$R^{54}$ represents a hydrogen atom, an alkyl group or an aryl group;

$R^{36}$, $R^{37}$, $R^{38}$ and $R^{39}$ each represents a hydrogen atom, an alkyl group having from 1 to 4 carbon atoms or an aryl group having from 6 to 10 carbon atoms and may be the same or different;

$R^{36}$ and $R^{37}$, and/or $R^{38}$ and $R^{39}$ each may be bonded to each other to form an aromatic ring or a 5- to 8-membered ring; F represents a compound capable of bonding to $M^{22}$ by a coordination bond, and the coordination number of the compound is from 1 to 5;

$R^{40}$, $R^{41}$, $R^{42}$ and $R^{43}$ each represents a hydrogen atom, an alkyl group, an aryl group or a heterocyclic group and may be the same or different;

$R^{40}$ and $R^{41}$, and/or $R^{42}$ and $R^{43}$ may be bonded to each other to form a ring structure;

$X^{14}$, $X^{15}$, $X^{16}$ and $X^{17}$ each represents a sulfur atom or an oxygen atom and may be the same or different;

$M^{23}$ represents nickel, cobalt or iron; and $R^{44}$, $R^{45}$, $R^{46}$, $R^{47}$, $R^{48}$, $R^{49}$ and $R^{50}$ each represents a non-metallic substituent and may be the same or different.

Examples of anti-fading groups of $M_1$, $M_2$, $M_3$ and $M_4$ of the present invention are set forth below. In the examples below,

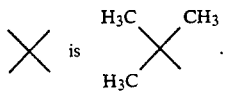

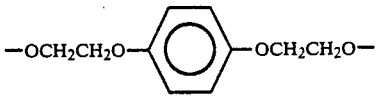
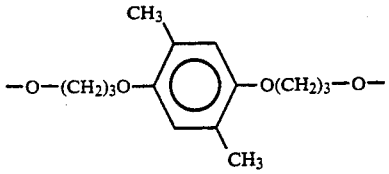
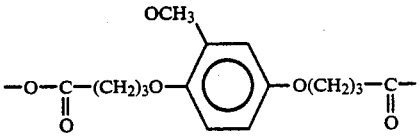
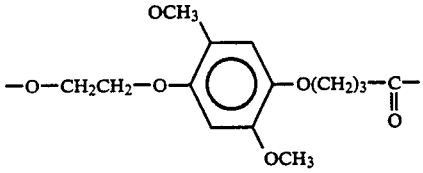
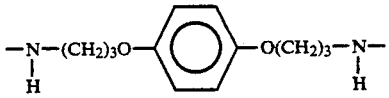
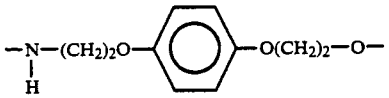
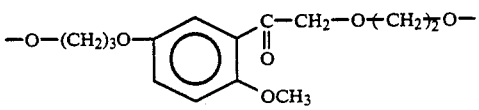
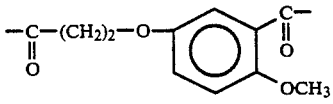
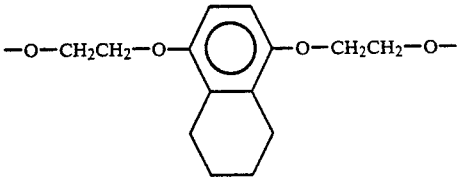
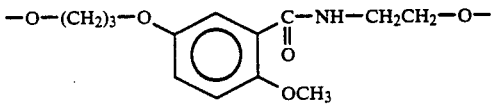
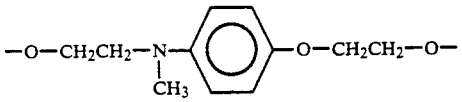
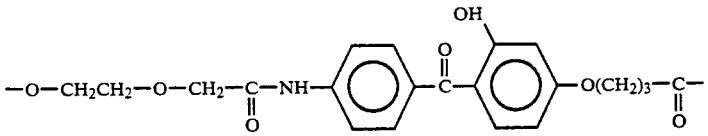
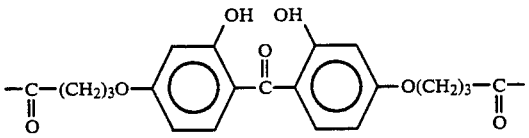
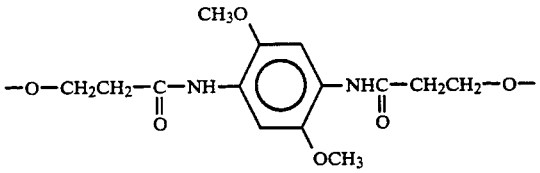
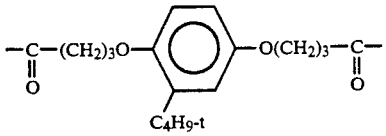
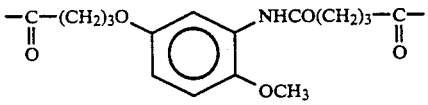
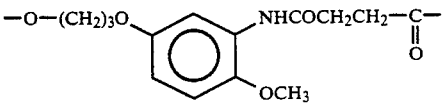
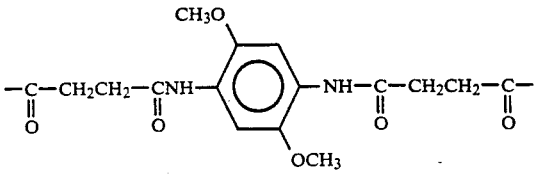

-continued
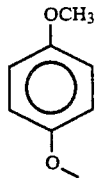
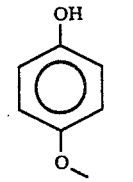
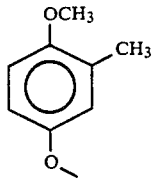
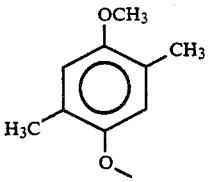
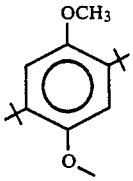
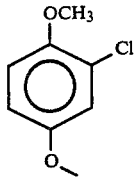
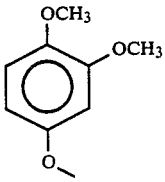
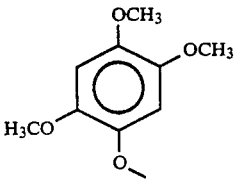
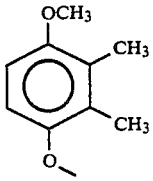
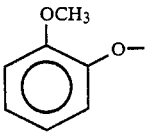
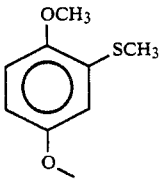
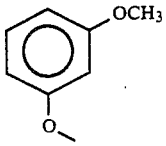
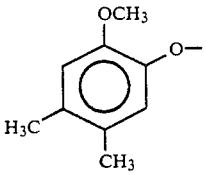
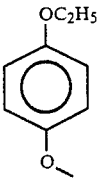
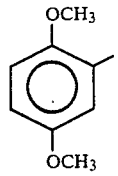
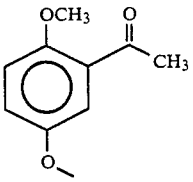
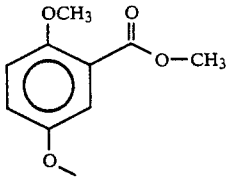
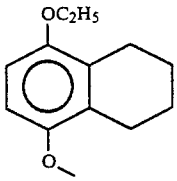
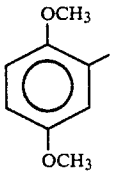
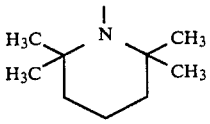
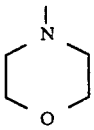
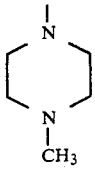
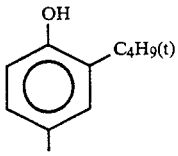
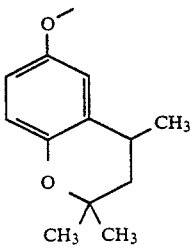

-continued
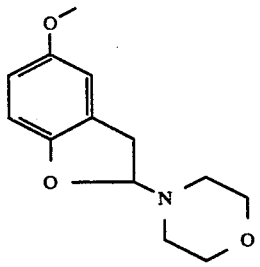
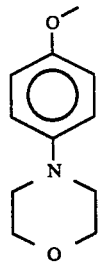
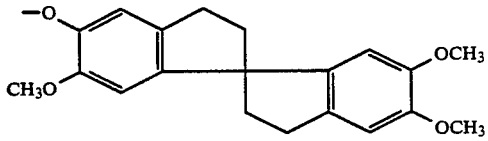
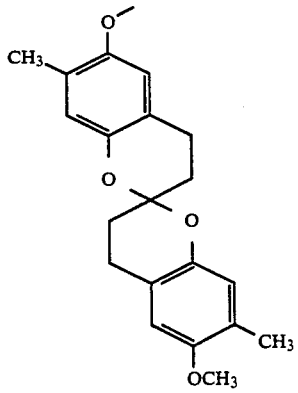
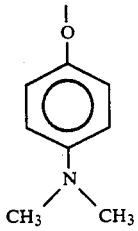
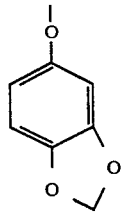
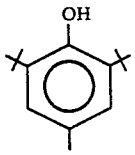
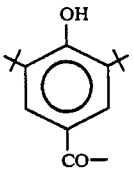
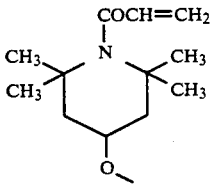
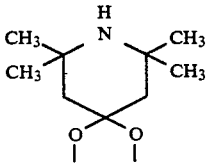
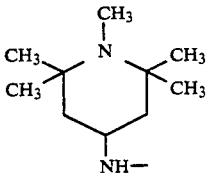
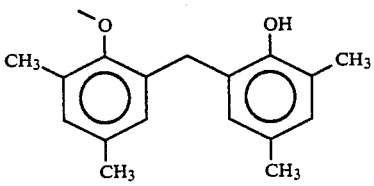

-continued

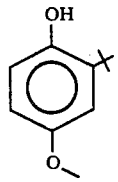

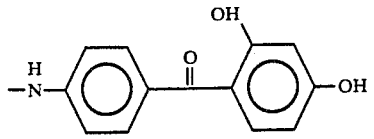

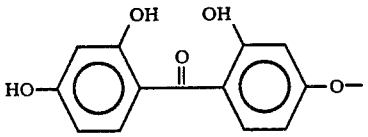

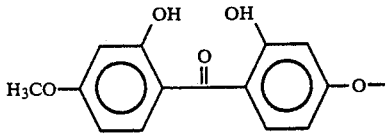

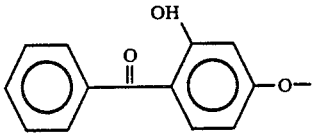

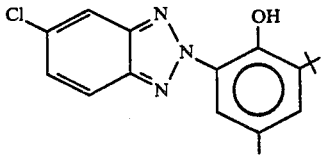

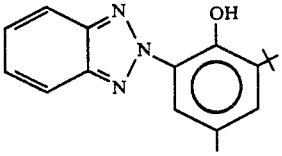

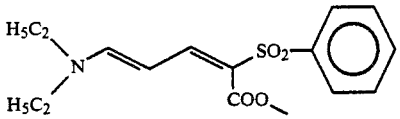

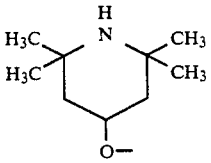

Thermoplastic resins having anti-fading groups in the molecule for use in the present invention are polyesters obtained by polycondensation of monomers of diols and dicarboxylic acids (or their esters) of the above-mentioned formulae (1), (2), (3) and (4) or monomers of the above-mentioned formulae (1), (2), (5) and ( 6 ).

Diols of formula (1) include, for example, ethylene glycol, diethylene glycol, triethylene glycol, polyethylene glycol, neopentyl glycol, propylene glycol, 1,4-butanediol, 1,5-pentanediol, 1,6-hexanediol, polytetramethylene glycol, 1,4-cyclohexanedimethanol, trimethylolpropane, pentaerythritol, bisphenol A, as well as the following compounds:

CHDM:

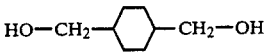

HBPA:

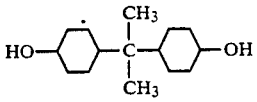

BPAEG:

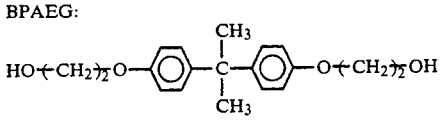

Dicarboxylic acids and their esters of formula (2) include, for example, terephthalic acid, isophthalic acid, phthalic acid, 2,6-naphthalene-dicarboxylic acid, biphenyl-dicarboxylic acid, adipic acid, suberic acid, azelaic acid, sebacic acid, dodecane-dicarboxylic acid, 1,4-cyclohexane-dicarboxylic acid, trimellitic acid, and their esters.

Diols of formula (3) include, for example, the following compounds:

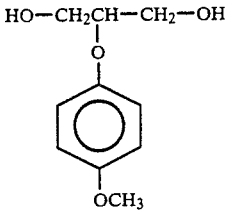

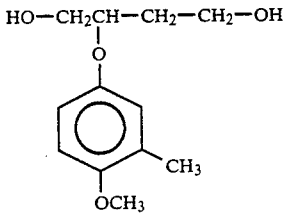

-continued
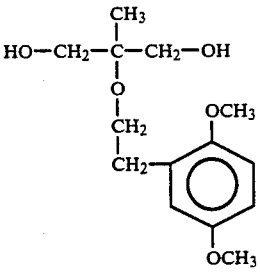
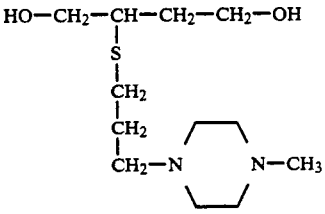
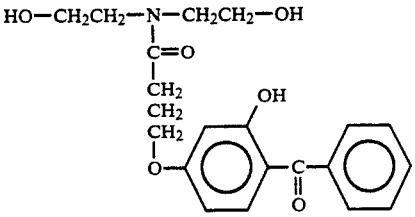
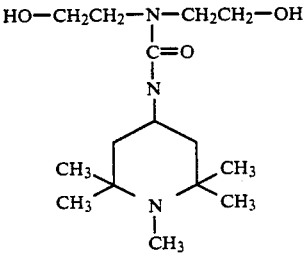
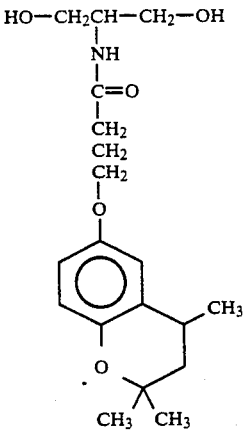
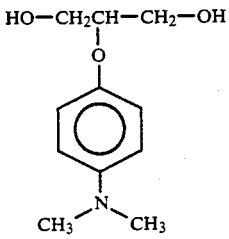
-continued
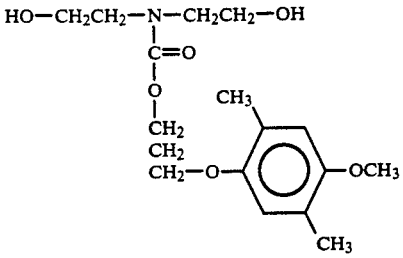
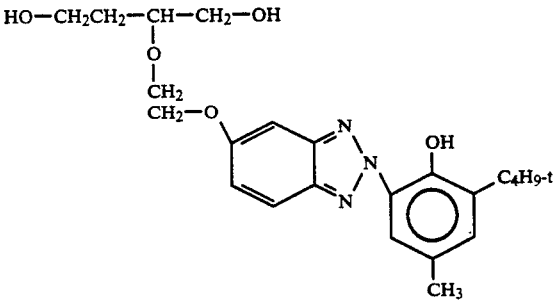
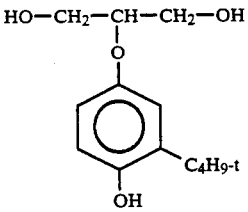
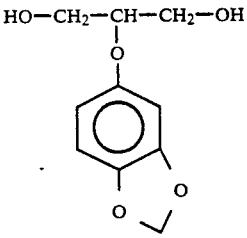
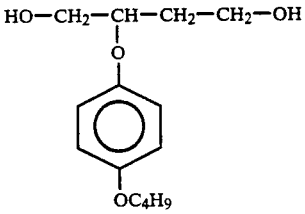
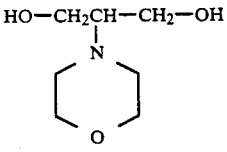
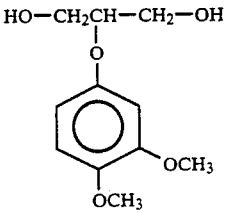

-continued
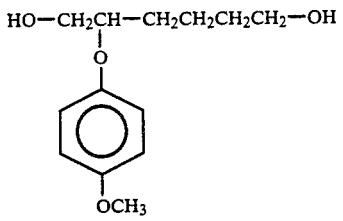
Dicarboxylic acids and their diesters of formula (4) include, for example, the following compounds:
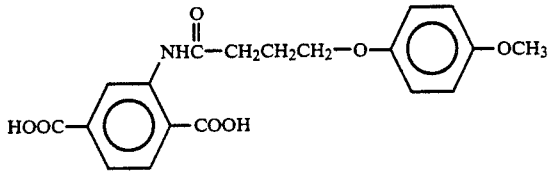
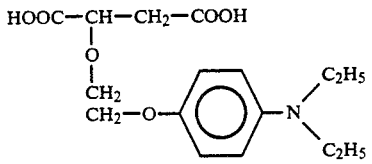
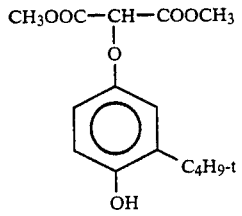
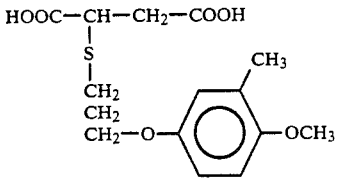
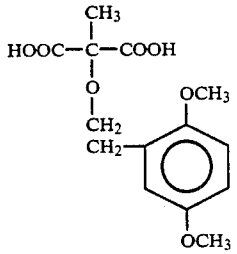
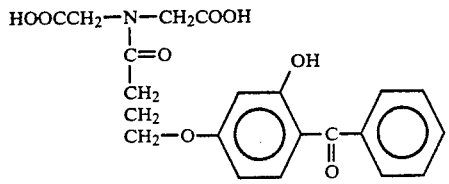
-continued
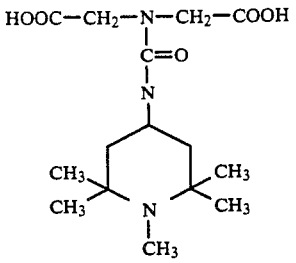
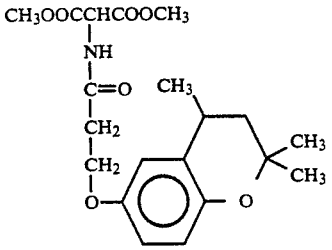
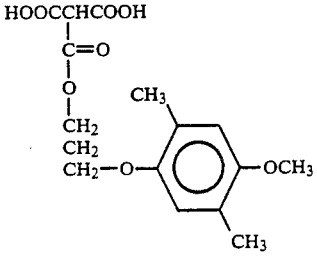
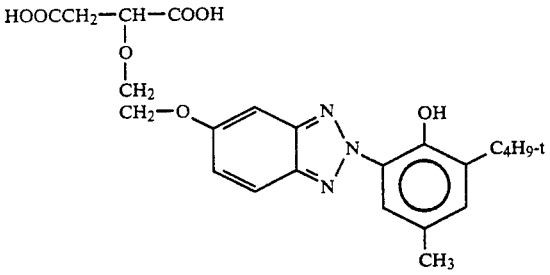
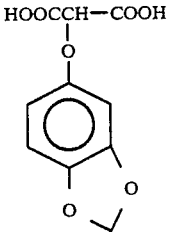
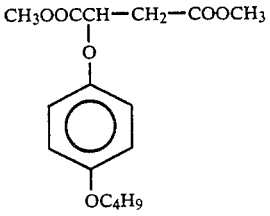

-continued
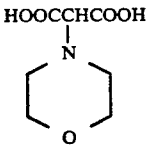
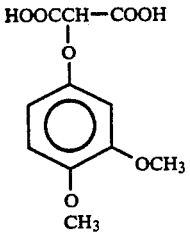
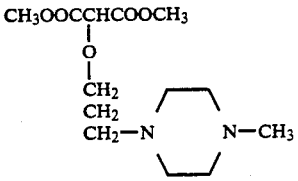
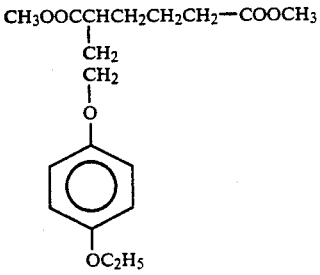
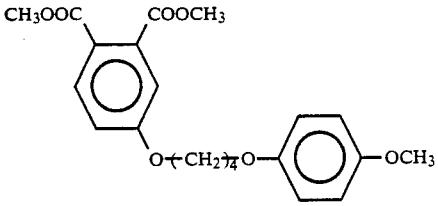
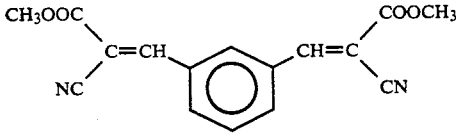
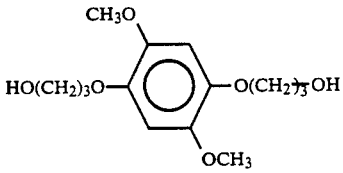
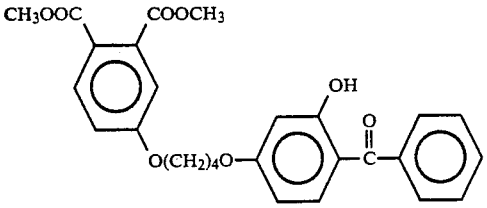
Examples of polymers of the thermoplastic resin of the present invention are shown in Table 1 to Table 5 below, along with their compositions. Definitions of abbreviations:
TPA;
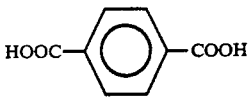
NPG;
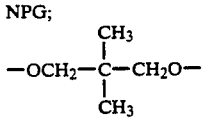
IPA;
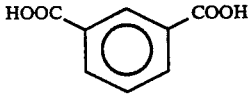
CHDM;
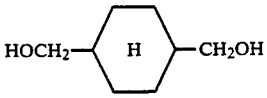
SBA;
$HOOC\text{-}(CH_3)_8\text{-}COOH$
SIPA;
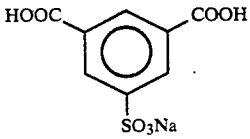
HBPA;
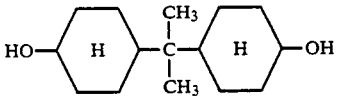
EG;
$HOCH_2CH_2OH$
BPAEG;
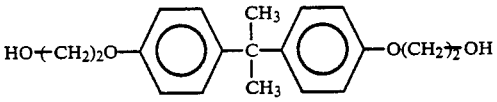
DEG;
$HO\text{-}(CH_2CH_2O)_2\text{-}H$
HQG;
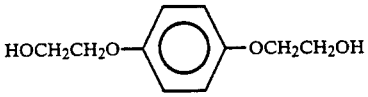
MPBP;
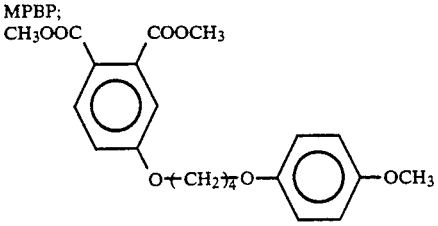

-continued

BCAI;

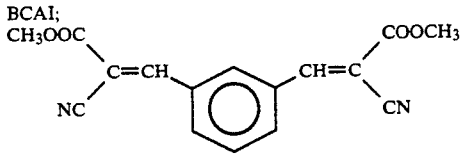

DMHQG;

-continued

BPBP;

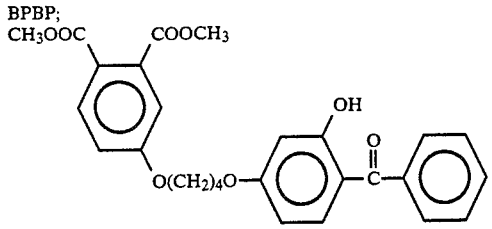

TABLE 1

| | Ratio of Constitutive Monomer Components (mol %) | | | | | | | | | | |
|---|---|---|---|---|---|---|---|---|---|---|---|
| | Dicarboxylic Acid Components | | | | | Diol Components | | | | | |
| Resin | TPA | IPA | SBA | SIPA | EG | DEG | NPG | CHDM | HBPA | BPAEG | HQG |
| 1 | 25 | 25 | — | — | 15 | — | 10 | — | — | — | 25 |
| 2 | 25 | 25 | — | — | 15 | — | 25 | — | — | — | 10 |
| 3 | 24.5 | 24.5 | — | 1.0 | 15 | — | 10 | — | — | — | 25 |
| 4 | 24.5 | 24.5 | — | 1.0 | 15 | — | 25 | — | — | — | 10 |
| 5 | 20 | 20 | 10 | — | 25 | — | — | — | — | — | 25 |
| 6 | 25 | 25 | — | — | 20 | 5 | — | — | — | — | 25 |
| 7 | 25 | 25 | — | — | 20 | — | — | 10 | — | — | 20 |
| 8 | 25 | 25 | — | — | 20 | — | — | — | 10 | — | 20 |
| 9 | 25 | 25 | — | — | 20 | — | — | — | — | 10 | 20 |
| 10 | 20 | 20 | 10 | — | 20 | 10 | — | — | — | — | 20 |
| 11 | 20 | 20 | 9 | 1 | 20 | 10 | — | — | — | — | 20 |

TABLE 2

| | Ratio of Constitutive Monomer Components (mol %) | | | | | | | | | | |
|---|---|---|---|---|---|---|---|---|---|---|---|
| | Dicarboxylic Acid Components | | | | Diol Components | | | | | | |
| Resin | TPA | IPA | SBA | SIPA | EG | DEG | NPG | CHDM | HBPA | BPAEG | DMHQG |
| 12 | 25 | 25 | — | — | 15 | — | 10 | — | — | — | 25 |
| 13 | 25 | 25 | — | — | 15 | — | 25 | — | — | — | 10 |
| 14 | 24.5 | 24.5 | — | 1.0 | 15 | — | 10 | — | — | — | 25 |
| 15 | 24.5 | 24.5 | — | 1.0 | 15 | — | 25 | — | — | — | 10 |
| 16 | 20 | 20 | 10 | — | 25 | — | — | — | — | — | 25 |
| 17 | 25 | 25 | — | — | 20 | 5 | — | — | — | — | 25 |
| 18 | 25 | 25 | — | — | 20 | — | — | 10 | — | — | 20 |
| 19 | 25 | 25 | — | — | 20 | — | — | — | 10 | — | 20 |
| 20 | 25 | 25 | — | — | 20 | — | — | — | — | 10 | 20 |
| 21 | 20 | 20 | 10 | — | 20 | 10 | — | — | — | — | 20 |
| 22 | 20 | 20 | 9 | 1 | 20 | 10 | — | — | — | — | 20 |

TABLE 3

| | Ratio of Constitutive Monomer Components (mol %) | | | | | | | | | | |
|---|---|---|---|---|---|---|---|---|---|---|---|
| | Dicarboxylic Acid Components | | | | | Diol Components | | | | | |
| Resin | TPA | IPA | SBA | SIPA | BCAI | EG | DEG | NPG | CHDM | HBPA | BPAEG |
| 23 | 12.5 | 12.5 | — | — | 25.0 | 25 | — | 25 | — | — | — |
| 24 | 12.5 | 27.5 | — | — | 10.0 | 25 | — | 25 | — | — | — |
| 25 | 12.5 | 32.5 | — | — | 5.0 | 25 | — | 25 | — | — | — |
| 26 | 12.5 | 12.5 | — | — | 25.0 | 25 | — | 25 | — | — | — |
| 27 | 10.5 | 10.5 | 4.0 | — | 25.0 | 25 | — | 25 | — | — | — |
| 28 | 12.5 | 12.5 | — | 1.0 | 24.0 | 25 | — | 25 | — | — | — |
| 29 | 12.5 | 12.5 | — | — | 25.0 | 23 | 2.0 | 25 | — | — | — |
| 30 | 12.5 | 12.5 | — | — | 25.0 | 25 | — | 20 | 5 | — | — |
| 31 | 12.5 | 12.5 | — | — | 25.0 | 25 | — | 20 | — | 5 | — |
| 32 | 12.5 | 12.5 | — | — | 25.0 | 25 | — | 20 | — | — | 5 |
| 33 | 12.5 | 12.5 | — | — | 25.0 | 23 | 2.0 | 20 | 5 | — | — |

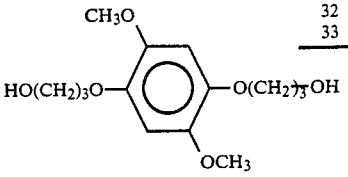

TABLE 4

| | Ratio of Constitutive Monomer Components (mol %) | | | | | | | | | | |
|---|---|---|---|---|---|---|---|---|---|---|---|
| | Dicarboxylic Acid Components | | | | | Diol Components | | | | | |
| Resin | TPA | IPA | SBA | SIPA | MPBP | EG | DEG | NPG | CHDM | HBPA | BPAEG |
| 34 | 12.5 | 12.5 | — | | 25.0 | 25 | — | 25 | — | — | — |

TABLE 4-continued

| | Ratio of Constitutive Monomer Components (mol %) | | | | | | | | | | |
|---|---|---|---|---|---|---|---|---|---|---|---|
| | Dicarboxylic Acid Components | | | | | Diol Components | | | | | |
| Resin | TPA | IPA | SBA | SIPA | MPBP | EG | DEG | NPG | CHDM | HBPA | BPAEG |
| 35 | 12.5 | 27.5 | — | — | 10.0 | 25 | — | 25 | — | — | — |
| 36 | 12.5 | 32.5 | — | — | 5.0 | 25 | — | 25 | — | — | — |
| 37 | 12.5 | 12.5 | — | — | 25.0 | 25 | — | 25 | — | — | — |
| 38 | 10.5 | 10.5 | 4.0 | — | 25.0 | 25 | — | 25 | — | — | — |
| 39 | 12.5 | 12.5 | — | 1.0 | 24.0 | 25 | — | 25 | — | — | — |
| 40 | 12.5 | 12.5 | — | — | 25.0 | 23 | 2.0 | 25 | — | — | — |
| 41 | 12.5 | 12.5 | — | — | 25.0 | 25 | — | 20 | 5 | — | — |
| 42 | 12.5 | 12.5 | — | — | 25.0 | 25 | — | 20 | — | 5 | — |
| 43 | 12.5 | 12.5 | — | — | 25.0 | 25 | — | 20 | — | — | 5 |
| 44 | 12.5 | 12.5 | — | — | 25.0 | 23 | 2.0 | 20 | 5 | — | — |

TABLE 5

| | Ratio of Constitutive Monomer Components (mol %) | | | | | | | | | | |
|---|---|---|---|---|---|---|---|---|---|---|---|
| | Dicarboxylic Acid Components | | | | | Diol Components | | | | | |
| Resin | TPA | IPA | SBA | SIPA | BPBP | EG | DEG | NPG | CHDM | HBPA | BPAEG |
| 45 | 12.5 | 12.5 | — | — | 25.0 | 25 | — | 25 | — | — | — |
| 46 | 12.5 | 27.5 | — | — | 10.0 | 25 | — | 25 | — | — | — |
| 47 | 12.5 | 32.5 | — | — | 5.0 | 25 | — | 25 | — | — | — |
| 48 | 12.5 | 12.5 | — | — | 25.0 | 25 | — | 25 | — | — | — |
| 49 | 10.5 | 10.5 | 4.0 | — | 25.0 | 25 | — | 25 | — | — | — |
| 50 | 12.5 | 12.5 | — | 1.0 | 24.0 | 25 | — | 25 | — | — | — |
| 51 | 12.5 | 12.5 | — | — | 25.0 | 23 | 2.0 | 25 | — | — | — |
| 52 | 12.5 | 12.5 | — | — | 25.0 | 25 | — | 20 | 5 | — | — |
| 53 | 12.5 | 12.5 | — | — | 25.0 | 25 | — | 20 | — | 5 | — |
| 54 | 12.5 | 12.5 | — | — | 25.0 | 25 | — | 20 | — | — | 5 |
| 55 | 12.5 | 12.5 | — | — | 25.0 | 23 | 2.0 | 20 | 5 | — | — |

The thermoplastic resin of the present invention preferably contains the anti-fading group-containing monomers in an amount of 1 mol % or more, preferably from 5 mol % to 50 mol %, of the total monomer components constituting the resin. In particular, where the thermoplastic resin for use in the present invention is a polyester, those having a component ratio mentioned below are preferably.

It is desired that the amount of the diol components of formulae (1)+(3) or of formulae (1)+(5) is 50 mol % and the amount of the dicarboxylic acid components of formulae (2)+(4) or of formulae (2)+(6) is 50 mol %. Also, it is preferred that the amount of at least one of the monomers of formulae (3), (4), (5) and (6) is 5 mol % or more based on the total amount of monomers in the resin. More preferably, the monomers of formulae (3) and (4) or (5) and (6) each is contained in an amount within the range of from 0 to 50 mol % based on the total amount of monomers in the resin; and the sum of the monomers of formulae (3) and (4) or (5) and (6) is within the range of from 5 to 50 mol % based on the total sum of the monomers in the resin.

Preparation of the polymers of the thermoplastic resin is illustrated below.

PRODUCTION EXAMPLES

1. Production of Resin 1 in Table 1

(1) Production of 1,4-bis(2'-hydroxyethoxy)benzene (HQG)

110.1 g (1 mol) of hydroquinone and 100 ml of dimethyl sulfoxide (DMSO) were put in a 100-ml three-neck flask and dissolved under heat at 135° to 140° C. 11.22 g (0.2 mol) of KOH were added thereto, and ethylene oxide was blown into the flask while stirring. At the point when a weight increase of about 90 g (theoretical amount: 88.1 g) was attained, the blowing was stopped and the reaction system was slightly cooled. Then, methanol was added thereto and dissolved, and the mixture was neutralized with concentrated HCl. After the solvent was removed by distillation under reduced pressure, 800 ml of ethyl acetate was added and dissolved under heat. The salt formed was removed by filtration, and the filtrate was cooled to give crystals. Thus, 27.3 g of pale gray crystals were obtained.

These were identified to be the intended product by gas chromatography and NMR.

(2) Production of Resin 1

9.71 g (0.05 mol) of dimethyl terephthalate, 9.71 g (0.05 mol) of dimethyl isophthalate, 9.9 g (0.05 mol) of HQG, 9.3 g (-0.15 mol) of ethylene glycol and, as condensation catalysts, 0.03 g of calcium acetate and 0.03 g of antimony(III) oxide were put in a three-neck flask equipped with a stirrer, a thermometer and a distillation tube and stirred in an oil bath for 30 minutes at 150° C. and then for one hour at 180° to 200° C. with introducing nitrogen thereinto to cause a reaction of the reactants, and methanol and a part of the ethylene glycol were distilled out. Next, the temperature was lowered to about 150° C. and the nitrogen-introducing tube was shut, and the vacuum degree in the reaction system was gradually elevated by operating a pump with stirring to a final reduced pressure of from 0.1 to 0.3 mmHg. Ethylene glycol began to distill out. Next, the temperature was gradually elevated to 180° to 200° C., and the reaction was further effected at a temperature of 180° to 200° C. for about 2 hours.

The reaction product was taken out while hot. The composition (in molar ratio) of the polyester thus formed was identified to comprise terephthalic acid (25.0), isophthalic acid (25.0), HQG (24.5) and ethylene glycol (25.0) by NMR. The molecular weight of the polyester was identified to be 14,000 by GPC (polystyrene standard). The product dissolved well in methylene chloride and in a mixed liquid of toluene/methyl ethyl ketone (1/1).

2. Production of Resin 23 (Table 3)

(1) Production of 1,3-bis(2',2'-cyanomethoxycarbonylethylene)benzene (BCAI)

26.8 g (0.2 mol) of isophthalic acid aldehyde was dissolved in 200 ml of benzene, and 0.22 g of benzoic acid and 2.4 ml of piperidine were added thereto.

The resulting solution was heated up to 70° C., and 49.6 g (0.5 mol) of methyl cyanoacetate was dropwise added thereto in about 30 minutes. After addition, the temperature was elevated further and reaction was continued under reflux, while water, as produced during the reaction, was distilled out of the system. At the point when an approximately theoretical amount (7.2 ml) of water was formed, the reaction was stopped. The reaction needed about 5 hours. During the reaction, crystals precipitated out and the reaction system became a dispersion of the crystals. After cooling, the crystals formed were taken out by filtration and recrystallized from DMAC. The yield was 40 g (67.5 %) and had a melting point of 204° C. By NMR, this was identified to be the intended product.

(2) Production of Resin 23

2.9 g (0.015 mol) of dimethyl terephthalate, 2.9 g (0.015 g) of dimethyl isophthalate, 8.9 g (0.03 mol) of BCAI, 3.1 g (0.03 mol) of neopentyl glycol, 5.6 g (0.09 mol) of ethylene glycol and, as condensation catalysts, 0.008 g of calcium acetate and 0.008 g of antimony(III) oxide were put in a three-neck flask equipped with a stirrer, a thermometer and a distillation tube and stirred in an oil bath for 30 minutes at 150° C. and for one hour at 180° to 200° C. with introducing nitrogen thereinto to cause a reaction, and methanol and a part of the ethylene glycol were distilled out. Next, the temperature was lowered to about 150° C., and the nitrogen-introducing tube was shut, and the vacuum degree in the reaction system was gradually elevated by operating a pump with stirring to a final reduced pressure of from 0.1 to 0.3 mmHg. Ethylene glycol began to distill out. Next, the temperature was gradually elevated to 180° to 200° C, and the reaction was further effected at a temperature of 180° to 200° C. for about 2 hours.

The reaction product was taken out while hot. The composition (in molar ratio) of the polyester thus formed was identified to comprise terephthalic acid (12.5), isophthalic acid (12.5), BCAI (24.5), neopentyl glycol (24.0) and ethylene glycol (25.0) by NMR. The molecular weight of the polyester was identified to be about 7,000 by GPC (polystyrene standard). This product dissolved well in methylene chloride and in a mixed liquid of toluene/methyl ethyl ketone (1/1).

3. Production of Resin 34 (Table 4)

(1) Production of p-methoxyphenoxy-1-bromobutane 261 g (1.2 mols) of 1,4-bromobutane, 58.1 g (1.45 mols) of NaOH, 3.8 g of tetrabutylammonium bromide, 460 ml of water and 460 ml of toluene were put in a 2-liter three-neck flask and 75 g (0.605 mol) of p-methoxyphenol was added in three divided portions with stirring at 75° C. After continuous stirring for 5 hours at 75° C., the reaction system was cooled to room temperature and was subjected to liquid-liquid separation. The upper layer (toluene layer) was taken out, toluene was removed therefrom by distillation, and the remaining liquid was distilled under reduced pressure. The intended product was thus obtained. The product had a boiling point of from 125° to 128° C./0.15 mmHg. The yield was 96 g (61%).

(2) Production of dimethyl 4-[4'-(p-methoxyphenoxy)butoxy]phthalate (MPBP):

21.0 g (0.1 mol) of dimethyl 4-hydroxyphthalate, 25.9 g (0.1 mol) of p-methoxyphenoxy-l-bromobutane and 100 ml of acetonitrile were put in a 300-ml three-neck flask, and 6.91 g of potassium carbonate was added in three divided portions at two-hour intervals at 70° to 80° C. The reaction system was stirred further for 7 hours under reflux. The system was cooled to room temperature, and the salts formed and acetonitrile were taken out by filtration and distillation, respectively. Ethyl acetate and water were added to the residue, which was then washed well with water. Ethyl acetate was removed by distillation, and the residue was recrystallized from a mixed solvent of hexane/ethyl acetate (6/4, v/v). 28.0 g of the intended product was obtained, having a melting point of 68° C. The yield was 72.0%.

(3) Production of Resin 34

2.9 g (0.015 mol) of dimethyl terephthalate, 2.9 g (0.015 mol) of dimethyl isophthalate, 11.64 g (0.03 mol) of MPBP, 3.1 g (0.03 mol) of neopentyl glycol, 5.6 g (0.09 mol) of ethylene glycol and, as condensation catalysts, 0.008 g of calcium acetate and 0.008 g of antimony(III) oxide were put in a three-neck flask equipped with a stirrer, a thermometer and a distillation tube and stirred in an oil bath for 30 minutes at 150° C. and for one hour at 180° to 200° C. with introducing nitrogen thereinto to cause a reaction, and methanol and a part of the ethylene glycol were distilled out. Next, the temperature was lowered to about 150° C., and the nitrogen-introducing tube was shut, and the vacuum degree in the reaction system was gradually elevated by operating a pump with stirring to a final reduced pressure of from 0.1 to 0.3 mmHg. Ethylene glycol began to distill out. Next, the temperature was gradually elevated to be 180° to 200° C., and the reaction was further effected at a temperature of 180° to 200° C. for about 2 hours.

The reaction product was taken out while hot. The composition (in molar ratio) of the polyester thus formed was identified to comprise terephthalic acid (12.5), isophthalic acid (12.5), MPBP (24.1), neopentyl glycol (24.3) and ethylene glycol (25.0) by NMR. The molecular weight of the polyester was identified to be about 4,000 by GPC (polystyrene standard). The product dissolved well in methylene chloride and in a mixed liquid of toluene/methyl ethyl ketone (1/1).

The support of the thermal transfer image-receiving material of the present invention is not restricted and any known support can be used.

General examples of supports usable in the present invention are mentioned below.

(1) Synthetic paper (e.g., polyolefin synthetic paper, polystyrene synthetic paper);

(2) paper support such as high-quality paper, art paper, coated paper, cast-coated paper, wallpaper, lining paper, synthetic resin- or emulsion-impregnated paper, synthetic rubber latex-impregnated paper, synthetic resin-incorporated paper, sheet paper, cellulose fiber paper, polyolefin-coated paper (especially, paper having polyethylene coated on both surfaces thereof); and ③ various plastic films or sheets of polyolefins, polyvinyl chloride, polyethylene terephthalate, polystyrene, polymethacrylates or polycarbonates, as well as films or sheets prepared by treating these plastics to make them white reflective.

In addition, laminates comprising any of the above-mentioned ① to ③ may also be used.

Polyolefin-coated papers are preferred because of their various advantages, i.e., they do not cause concave deformation under the heat for the thermal transfer operation, they have excellent whiteness, and they are hardly curled.

Polyolefin-coated papers are described in, for example, *Basis of Photographic Engineering* (section of silver salt photographs) (edited by Japan Photographic Association, published by Corona Co.), pages 223 to 240. The polyolefin-coated papers are basically composed of a support sheet and a polyolefin layer coated on the surface of the sheet.

Polyolefins used for the papers include high-density polyethylene, low-density polyethylene and polypropylene. In consideration of the heat-insulating effect during transfer operation, preferably a low-density polyethylene having a lower thermal conductivity at the side to be coated with an image-receiving layer is used.

The thickness of the polyolefin coat of the papers is not specifically defined but is generally preferably from 5 to 100 μm, more preferably from 5 to 70 μm, as the coat on one surface. However, in order to obtain a higher transferred density, the thickness of the polyolefin coat of the side coated with an image-receiving layer is desirably thinner. The polyolefin coat may contain a pigment such as titanium oxide or ultramarine as well as a filler, for the purpose of increasing the whiteness. The polyolefin-coated papers may have a thin gelatin layer of from approximately 0.05 to 0.4 g/m$^2$ on the surface(s) thereof (the side to be coated with an image-receiving layer and/or the back surface thereof).

The thermal transfer image-receiving material of the present invention has a color image-receiving layer. The image-receiving layer is one which acts to receive the dye as transferred from a thermal transfer dye-providing material and to fix it in the layer during printing. The image-receiving layer contains a thermoplastic resin as a dye-receiving resin. The image-receiving layer is preferably a film having a thickness of from 0.5 to 50 μm.

In the present invention, a thermoplastic resin having anti-fading groups in the molecule is used as the resin in the image-receiving layer. The thermoplastic resin having anti-fading groups in the molecule include the above-mentioned resins.

In addition to the above-mentioned synthetic resins, mixtures or copolymers of these resins may also be used.

The particular thermoplastic resin of the present invention preferably contains anti-fading group-containing monomer components in an amount of 1% or more of the total monomer components.

The thermoplastic resin of the present invention is preferably coated in an amount of from 1 g to 100 g per m$^2$ of the support.

Two or more different kinds of anti-fading group-containing thermoplastic resins may be used as a mixture in the present invention. If desired, the resin(s) may be combined with any other anti-fading group-free dye-receiving resin(s). In this case, the content of the anti-fading group-containing thermoplastic resin(s) of the present invention is preferably from 5 to 100% by weight of the total weight of all the resins in the image-receiving layer.

The thermal transfer image-receiving material of the present invention may contain a thermal solvent or a high boiling point organic solvent, as a dye-receiving substance or a dye diffusion aid, in the image-receiving layer.

Thermal solvents include compounds having various properties such that ① they are incompatible with water-soluble binders which are compatible with dyes, ② they are solid at room temperature but melt when heated with a thermal head during transfer operation (melting may be effected by admixture with any other components), and ③ they do not decompose when heated with a thermal head. Preferable compounds include compounds having a melting point of from 35° to 250° C., preferably from 35° to 200° C. and having a value of inorganicity/organicity of being less than 1.5. The inorganicity and organicity as referred to herein indicate conceptions of predicting the properties of the compounds, and are described in, for example, *Range of Chemistry*, No. 11, page 719 (1957).

Specific examples of high boiling point organic solvents and thermal solvents usable in the present invention include compounds described in JP-A-62-174754 (the term "JP-A" as used herein means an "unexamined published Japanese patent application"), JP-A-62-245253, JP-A-61-209444, JP-A-61-200538, JP-A-62-8145, JP-A-62-9348, JP-A-62-30247 and JP-A-62-136646.

The high boiling organic solvent and/or the thermal solvent can be present singly in the image-receiving layer in the form of a microdispersion, or may also be present in the layer as a mixture with a dye-receiving polymer.

The above-mentioned high boiling point organic solvents may also be used for the purpose of improving the slide property, releasability and curling balance.

The image-receiving layer of the thermal transfer image-receiving material of the present invention may have either ① a constitution where a substance capable of receiving a thermomobile dye is singly provided on a support or ② a constitution where a substance capable of receiving a thermomobile dye is provided on a support as a dispersion thereof in a water-soluble binder. As a water-soluble binder for case ②, any known water-soluble polymer may be used. Preferably, a water-soluble polymer having a group capable of being cross-linked with a hardening agent is used.

Water-soluble polymers usable in the present invention include vinyl polymers and their derivatives, such as polyvinyl alcohol, polyvinyl pyridinium and cation-modified polyvinyl alcohol (which are described in JP-A-60-145879, JP-A-60-220750, JP-A-61-143177, JP-A-61-235182, JP-A-61-245183, JP-A-61-237681, JP-A-61-261089); acrylic acid-containing polymers, such as polyacrylamide, polydimethylacrylamide, polydimethylaminoacrylate, polyacrylic acids and their salts, acrylic acid-methacrylic acid copolymers and their salts, polymethacrylic acids and their salts, and acrylic acid-vinyl alcohol copolymers and their salts (which are described in JP-A-60-168651, JP-A-62-9988); natural polymers and their derivatives such as starch, starch oxide, starch acetate, amine starch, carboxyl starch, dialdehyde starch, cation starch, dextrin, sodium alginate, gelatin, gum arabic, casein, pullulane, dextran, methyl cellulose, ethyl cellulose, carboxymethyl cellulose, and hydroxypropyl cellulose (which are described in JP-A-59-174382, JP-A-60-262685, JP-A-61-143177, JP-A-61-181679, JP-A-61-193879, JP-A-61-287782); synthetic polymers such as polyethylene glycol, polypropylene glycol, polyvinyl methyl ether, maleic acid-vinyl acetate copolymers, maleic acid-N-vinylpyrrolidone copolymers, maleic acid-alkyl vinyl ether copolymers, and polyethyleneimine (which are described in JP-A-61-32787, JP-A-61-237680, JP-A-61-277483); and water-soluble polymers described in JP-A-56-58869.

In addition, various other-copolymers solubilized by monomer components containing $SO_3'$, $COO^-$ or $SO_2'$ may also be used.

Use of gelatin as a water-soluble binder is especially preferred, as set drying is possible to noticeably reduce the drying load. Examples of gelatin usable for the purpose include various gelatins and their derivatives, such as lime-processed gelatin, lime-processed gelatin from which the calcium has been removed, acid-processed gelatin, phthalated gelatin, acetylated gelatin, and succinated gelatin; as well as enzyme-processed gelatins, hydrolysates of gelatin or enzyme-decomposed products of gelatin such as those described in *Bull. Soc. Phot.* Japan, No. 16, page 3 (1966).

The water-soluble polymers may be used singly; or two or more of them may be used in combination.

The water-soluble polymer and the dye-receiving substance are used in a weight ratio of dye-receiving substance/water-soluble polymer of from 1 to 20, preferably from 2 to 10, especially from 2.5 to 7.

Where the water-soluble binder is used, an aqueous solution containing the dye-receiving substance may be coated and dried to give an image-receiving layer.

As a method of dispersing the dye-receiving substance in the water-soluble binder, any known dispersion method of dispersing a hydrophobic substance in a water-soluble polymer may be employed. For instance, typical methods include an emulsification and dispersion method of blending a solution to be prepared by dissolving a dye-receiving substance in a water-immiscible organic solvent and an aqueous solution of a water-soluble binder, and a method of blending a latex of a dye-receiving substance (polymer) and an aqueous solution of a water-soluble binder.

The aqueous liquid may be either an aqueous solution of a water-soluble dye-receiving resin or a blended solution comprising the aqueous solution and a water-soluble polymer having low dye-receiving capacity; or may also be either a dispersion of fine dye-receiving grains or a blended solution comprising the dispersion and a water-soluble polymer having a low dye-receiving capacity.

The dye-receiving substance (polymer) may have water-soluble groups (e.g., COOM, $SO_3M$, —O—$SO_3M$, $(—OCH_2CH_2)n$; in which M is an alkali metal ion, and n is an integer) in order to be a water-soluble polymer, and may be used singly or in combination with the above-mentioned water-soluble binder.

Examples of a dye-receiving polymer latex or dye-receiving water-soluble polymer include Pluscoat Z-466, Z-448, Z-455, Z-461, Z-761 and Z-771 (trade names by Gooh Chemical Co.); Pesuresin A-1243, A-2141 and A-2151 (trade names by Takamatsu Oils and Fats Co.); and Finetex ES-611, ES-650, ES-670, ES-675 and ES-850 (trade names by Dai-Nippon Ink Co.)

In the thermal transfer image-receiving material of the present invention, the image-receiving layer may be a single layer or may be composed of two or more layers. In the latter case of providing two or more image-receiving layers on a support, it is preferable that the layer nearer to the support contains a synthetic resin having a low glass transition point (e.g., not higher than 50° C.) or contains a high boiling point organic solvent or a thermal solvent, so as to elevate the dye-fixing capacity of the layer. It is also preferable that the outermost layer contains a synthetic resin having a higher glass transition point or contains a reduced amount or minimized amount of a high boiling point organic solvent or a thermal solvent or does not contain the solvent, so as to prevent various problems such as surface sticking, adhesion to other substances, re-transference of the transferred dye to other substances and blocking with a thermal transfer dye-providing material.

The thickness of the dye-receiving material is, as a whole, from 0.5 to 50 μm, preferably from 3 to 30 μm. Where the material has a two-layer constitution, the outermost layer preferably has a thickness of from 0.1 to 20 μm, preferably from 0.2 to 10 μm.

The thermal transfer image-receiving material of the present invention may have an interlayer between the support and the image-receiving layer.

The interlayer can be any one of a cushion layer, a porous layer and a dye-diffusion inhibiting layer, depending upon the material used, or it may be a layer having two or more such functions. The interlayer may also act as an adhesive.

The dye-diffusion inhibiting layer is a layer which inhibits the transferred thermomobile dye from diffusing into the support. A binder which constitutes the diffusion inhibiting layer includes either a water-soluble or an organic solvent-soluble binder. Preferably, a water-soluble binder is used. Examples of preferred water-soluble binders include water-soluble binders previously mentioned for the binder of the image-receiving layer. Gelatin is especially preferred.

The porous layer prevents the heat which is imparted to the material during the thermal transfer operation from diffusing into the support. This fills the role of effectively utilizing the imparted heat.

When the water-soluble polymers are used as the binders for the porous layer, the porous layer can be formed by (1) a method wherein porous fine particles are dispersed in a water-soluble polymer and the dispersion is coated and dried, (2) a method wherein a solution of a water-soluble polymer is mechanically stirred to form bubbles and the solution is coated and dried, (3) a method wherein a blowing agent is added to a solution of a water-soluble polymer and either expansion is conducted and then the solution is coated, or expansion is conducted during the course of coating and drying, or (4) a method wherein an organic solvent (preferably a solvent having a boiling point higher than that of water) is emulsified and dispersed in a solution of a water-soluble polymer, the dispersion is coated and dried, and microvoids are formed during the course of coating and drying.

Where an organic solvent-soluble binder is used in forming a porous layer, various methods are employed. For instance, the methods include (1) a method in which a synthetic resin emulsion such as polyurethane or a synthetic rubber latex such as methyl methacrylate-butadiene is mechanically stirred to generate bubbles and the resulting liquid thus containing bubbles is coated on a support and dried; (2) a method in which the above-mentioned synthetic resin emulsion or synthetic rubber latex is blended with a foaming agent and the resulting liquid blend is coated on a support and dried; (3) a method in which a synthetic resin such as vinyl chloride plastisol or polyurethane or a synthetic rubber such as styrene-butadiene is blended with a foaming agent and the resulting liquid blend is coated on a support and foamed by heating; and (4) a method in which a solution of a thermoplastic resin or synthetic rubber dissolved in an organic solvent is blended with a non-solvent (including one consisting essentially of water), which is not as easy to evaporate with respect to the organic solvent and which is compatible with the solvent but is insoluble in the thermoplastic resin or synthetic rubber, and the resulting liquid blend is coated on a support and dried to form a microporous layer thereon.

An interlayer may be provided on both surfaces of a support when the support has an image-receiving layer on both surfaces thereof; or it may be provided only on one surface of a support.

The thickness of the interlayer is from 0.5 to 50 μm, preferably from 1 to 20 μm.

The image-receiving layer, cushion layer, porous layer, diffusion preventing layer and adhesive layer constituting the thermal transfer image-receiving material of the present invention may contain fine powder of silica, clay, talc, diatomaceous earth, calcium carbonate, calcium sulfate, barium sulfate, aluminium silicate, synthetic zeolite, zinc oxide, lithopone, titanium oxide, alumina, etc.

The thermal transfer image-receiving material of the present invention may contain a brightening agent. Examples of the brightening agent include compounds described in K. Veenkataraman, *The Chemistry of Synthetic Dyes,* Vol. 5, Chap. 8 and in JP-A-61-143752. More specifically, stilbene compounds, coumarin compounds, biphenyl compounds, benzoxazolyl compounds, naphthalimide compounds, pyrazoline compounds, carbostyryl compounds, and 2,5-benzoxazole-thiopenen compounds can be used.

The brightening agent may be in the material in combination with an anti-fading agent.

The thermal transfer dye-receiving material of the present invention is combined with a thermal transfer dye-providing material, which has a dye-providing layer containing a thermomobile dye on a support. The thermal transfer dye-providing material for use in the present invention can be separated into two groups. One group is such that a dye to be used in the material is pattern-wise transferred under heat to the image-receiving layer of the thermal transfer dye-receiving material of the present invention; and the other group is a thermal transfer dye-providing material having a thermofusion ink layer (dye-providing layer) on a support and the ink is pattern-wise melted under heat to be transferred to the thermal transfer dye-receiving material of the present invention for effecting recording.

The dye-providing layer contains a dye which is so selected that a desired color hue may be transferred to the printing material (dye-receiving material of the invention) in printing.

If desired, two or more dye-providing layers each having a different dye may be formed in parallel with each other on one thermal transfer dye-providing material. For instance, where a color photographic image is formed by repeating prints of different colors in accordance with color separation signals, the printed color hues preferably comprise cyan, magenta and yellow colors, and three dye-providing layers each containing the dye yielding each of these color hues are disposed on a support in parallel with each other.

A dye-providing layer containing a dye yielding a black hue may be added to the cyan-, magenta- and yellow-yielding layers. In forming these dye-providing layers, it is preferred to provide a position-detecting mark in the dye-providing material simultaneously with forming any one of the layers, since any other ink or printing step than that for formation of the dye-providing layers is unnecessary.

The support of the thermal transfer dye-providing layer includes any known support acceptable for the purpose. For instance, polyethylene terephthalate, polyamides, polycarbonates, glassine paper, condenser paper, cellulose esters, fluorine polymers, polyethers, polyacetals, polyolefins, polyimides, polyphenylene sulfide, polypropylene, polysulfone and cellophane can be used.

The thickness of the support of the thermal transfer dye-providing material is generally from 2 to 30 μm. If desired, it may have a subbing layer. A dye diffusion preventing layer comprising a hydrophilic polymer may be provided as an interlayer between the support and the dye-providing layer. By provision of such an interlayer, the transferring density would increase further. The hydrophilic polymer for this purpose can include the above-mentioned water-soluble polymers.

A slipping layer may be provided in the dye-providing material for the purpose of preventing the material from sticking to a thermal head during thermal transfer operation. Such a slipping layer is composed of a lubricant substance which may contain a polymer binder. Such a lubricant substance is, for example, a surfactant or a solid or liquid lubricant or a mixture thereof.

The thermal transfer dye-providing material containing a thermomobile dye is a material basically having a dye-providing layer containing a dye which sublimes or may be movable under heat and a binder on a support. The thermal transfer dye-providing material may be prepared by coating a coating solution or dispersion to be formed by dissolving or dispersing a known dye capable of subliming or being movable under heat and a binder resin in a suitable solvent, on one surface of a support, for example, in a dry thickness of approximately from 0.2 to 5 μm, preferably approximately from 0.4 to 2 μm, followed by drying the coated layer to form a thermal transfer layer on the support.

A dye usable for forming such a thermal transfer layer includes any dye used in preparing a conventional thermal transfer dye-providing material. Low molecular weight dyes having a molecular weight of approximately from 150 to 800 are especially preferred for use in the present invention. In actual use, these dyes are selected based on the transferring temperature, color hue, light fastness, and solubility and dispersibility in ink and binder resin.

Specifically, for example, disperse dyes, basic dyes and oil-soluble dyes are used. In particular, preferred dyes are Sumikaron Yellow E4GL, Dianix Yellow H2G-FS, Miketon Polyester Yellow 3GSL, Kayazet Yellow 937, Sumikaron Red EFGL, Dianix Red ACE, Miketon Polyester Red FB, Kayazet Red 126, Miketon Fast Brilliant Blue B, and Kayazet Blue 136 (all trade names). In addition to the dyes listed, other various known thermomobile dyes may also be used.

As the binder resin to be used along with the above-mentioned dyes, any binder resin appropriate for the desired purpose can be used. In general, resins which have high heat resistance and which do not interfere with migration of dyes under heat are selected.

For instance, polyamide resins, polyester resins, epoxy resins, polyurethane resins, polyacrylic resins (e.g., polymethyl methacrylate, polyacrylamide, polystyrene-2-acrylonitrile), polyvinyl pyrrolidone and other vinyl resins and polyvinyl chloride resins (e.g., vinyl chloride-vinyl acetate copolymers), polycarbonate resins, polystyrene, polyphenylene oxide, cellulose resins (e.g., methyl cellulose, ethyl cellulose, carboxymethyl cellulose, cellulose acetate hydrogen phthalate, cellulose acetate, cellulose acetate propionate, cellulose acetate butyrate, cellulose triacetate), polyvinyl alcohol resins (e.g., polyvinyl alcohol, partially saponified polyvinyl alcohol such as polyvinyl butyral), petroleum resins, rosin derivatives, chroman-indene resins, terpene resins, polyolefin resins (e.g., polyethylene, polypropylene), etc can be used.

The binder resin is desirably present in the dye-providing layer, for example, in a proportion of approximately from 80 to 600 parts by weight to 100 parts by weight of the dye therein.

An ink solvent to be used for dissolving or dispersing the above-mentioned dye and binder resin therein include any known ink solvent. Preparation of the ink composition and coating of it on a support may be carried out by any known technique.

Anti-sticking treatment is preferably applied to the dye-providing material at the side of the support not coated with the dye-providing layer. This application is for the purpose of preventing the material from sticking to a thermal head due to the heat of the head applied to the back surface of the material and for improving the slidability of the material in a thermal printing operation.

For instance, preferably, a heat-resistant slip layer consisting essentially of (1) a reaction product of a polyvinyl butyral resin and an isocyanate, (2) an alkali metal or alkaline earth metal salt of a phosphate ester and (3) a filler is provided.

The polyvinyl butyral resin for this purpose preferably has a molecular weight of approximately from 60,000 to 200,000 and a glass transition point of from 80° to 110° C. or has a polyvinyl butyral moiety content of from 15 to 40% by weight in view of the many reaction sites reactive to isocyanates.

The alkali metal or alkaline earth metal salt of a phosphate ester for this purpose includes Gafac RD720 (commercial product by Toho Chemical Co.). The amount of the ester is from about 1 to 50% by weight, preferably from 10 to 40% by weight, with respect to the polyvinyl butyral resin.

The heat-resistant slip layer is preferably combined with a heat-resistant layer as the layer under it, and the heat-resistant underlayer may be provided by coating a combination of a thermoserring synthetic resin and a hardening agent for the resin, for example, a combination of a polyvinyl butyral and a polyisocyanate, an acrylpolyol and a polyisocyanate, cellulose acetate and a titanium chelating agent, or a polyester and an organic titanium compound.

The dye-providing material may have a hydrophilic barrier layer for the purpose of preventing the dye from diffusing towards the direction of the support. The hydrophilic dye barrier layer contains a hydrophilic substance useful for the intended purpose. In general, excellent results may be obtained from the use of a poly(acrylamide), a poly(isopropylacrylamide), a butyl methacrylate-grafted gelatin, an ethyl methacrylate-grafted gelatin, a cellulose monoacetate, a methyl cellulose, a poly(vinyl alcohol), a poly(ethyleneimine), a poly(acrylic acid), a mixture of a poly(vinyl alcohol) and a poly(vinyl acetate), a mixture of a poly(vinyl alcohol) and a poly(acrylic acid), or a mixture of a cellulose monoacetate and a poly(acrylic acid). Especially preferred are a poly(acrylic acid), a cellulose monoacetate and a poly(vinyl alcohol).

The dye-providing material may have a subbing layer. Any subbing layer may be used with the material of the present invention, provided that it displays the desired effect. Preferred components of the layer include acrylonitrile-vinylidene chloride-acrylic acid copolymer (14/80/6, by weight), butyl acrylate-methacrylic acid-2-hydroxyethyl 2-aminoethylmethacrylate copolymer (30/20/50, by weight), linear/saturated polyesters such as Bostic 7650 (commercial product by Emheart Co. of Bostic Chemical Group), and chlorinated high-density poly(ethylene-trichloroethylene) resins. There is no particular limitation in the amount of the subbing layer coated. In general, the subbing layer is coated in an amount of from 0.1 to 2.0 g/m$^2$.

For the purpose of improving the releasability between the thermal transfer dye-providing material and the thermal transfer image-receiving material in carrying out the present invention, introduction of a release agent into the layer(s) constituting the dye-providing material and/or the image-receiving material is preferred. More preferably, the release agent is incorporated into both outermost layers which contact the image-receiving material and the dye-providing material.

Any known release agent may be used. For instance, the release agent includes solid or waxy substances such as polyethylene wax, amide wax or Teflon powder; fluorine or phosphate surfactants; and paraffin, silicone or fluorine oils. Silicone oil is especially preferred.

Examples of silicone oil include non-modified silicone oil and modified silicone oils such as amino-modified or epoxy-modified ones. For instance, various modified silicone oils as described in *Modified Silicone Oils* (published by Shin-Etsu Silicone Co.) pages 6 to 18B can be used.

Where the oil is incorporated into an organic solvent binder, an amino-modified silicone oil having groups capable of reacting with the crosslinking agent for the binder (for example, groups capable of reacting with isocyanates) is effective; and where the oil is emulsified and dispersed in a water-soluble binder, a carboxy-modified silicone oil (for example, a commercial product X-22-3710 by Shin-Etsu Silicone Co.) is effective.

The layers constituting the thermal transfer dye-providing material and the thermal transfer image-receiving material of the present invention may be hardened with a hardening agent.

For polyester resins, use of an isocyanate hardening agent is especially preferred.

For hardening water-soluble polymers, hardening agents as described in U.S. Pat. No. 4,678,739, column 41, and JP-A-59-116655, JP-A-62-245261 and JP-A-61-18942 are suitable. More preferably, aldehyde hardening agents (e.g., formaldehyde), aziridine hardening agents, epoxy hardening agents, vinylsulfone hardening agents (e.g., N,N'-ethylene-bis (vinylsulfonylacetamido) ethane), N-methylol hardening agents (e.g., dimethylolurea), and high polymer hardening agents (e.g., compounds described in JP-A-62-23457) are used.

The thermal transfer dye-providing material and the thermal transfer image-receiving material of the present invention may contain an anti-fading agent. Suitable anti-fading agents include, for example, antioxidants, ultraviolet absorbents and metal complexes.

Antioxidants include, for example, chroman compounds, coumaran compounds, phenolic compounds (e.g., hindered phenols), hydroquinone derivatives, hindered amine derivatives and spiroindane compounds. In addition, compounds described in JP-A-61-159644 are also effective.

Ultraviolet absorbents include, for example, benzotriazole compounds ( such as those described in U.S. Pat. No. 3,533,794 ), 4-thiazolidone compounds (such as those described in U.S. Pat. No. 3,352,681), benzothiophene compounds ( such as those described in JP-A-56-2784), as well as compounds described in JP-A-54-48535, JP-A-62-136641 and JP-A-61-88256. In addition, ultraviolet absorbing polymers as described in JP-A-62-260152 are also effective.

Usable metal complexes, for example, include compounds described in U.S. Pat. Nos. 4,241,155, 4,245,018 (columns 3 to 36), 4,254,195 (columns 3 to 8), JP-A-62-174741, JP-A-61-88256 (pages 27 to 29), and Japanese Patent Application Nos. 62-234103, 62-31096 and 62-230595 (corresponding to JP-A-1-75568, JP-A-63-199248, and JP-A-1-74272, respectively).

The above-mentioned antioxidants, ultraviolet absorbents and metal complexes may be used alone or in combination.

Examples of especially useful anti-fading agents are described in JP-A-62-215272 (pages 125 to 137).

The anti-fading agent for preventing the dyes transferred to the image-receiving material from fading may previously be incorporated into the image-receiving material, or may be supplied to the image-receiving material from an external source such as the dye-providing material or the like, for example, by transference to the image-receiving material.

The layers constituting the thermal transfer dye-providing material and the thermal transfer image-receiving material of the present invention may contain various surfactants as a coating aid or for the purpose of improving the releasability, slide property, antistatic property and developability of the materials.

Examples include nonionic surfactants, anionic surfactants, amphotelic surfactants and cationic surfactants, for instance, as described in, for example, JP-A-62-173463 and JP-A-62-183457.

Where substances capable of receiving thermomobile dyes, release agents, anti-fading agents, ultraviolet absorbents, brightening agents and other hydrophobic compounds are dispersed in water-soluble binders, surfactants are desirably used as a dispersion aid. For this purpose, more preferably, surfactants as described in JP-A-59-157636 (pages 37 to 38) are used in addition to the above-mentioned surfactants.

The layers constituting the thermal transfer dye-providing material and the thermal transfer image-receiving material of the present invention may contain organic fluoro compounds for the purpose of improving the slidability, antistatic property and releasability of the materials.

Examples of usable organic fluoro compounds include fluorine surfactants described in JP-B-57-9053 (columns 8 to 17) (the term "JP-B" as used herein means an "examined Japanese patent publication") and JP-A-61-20944 and JP-A-62-135826, as well as oily fluorine compounds such as fluorine oils, and solid fluorine compound resins such as tetrafluoroethylene resins, and other hydrophobic fluorine compounds. Specific examples include Daifree ME-313, ME-413, ME-414, ME-810, MS-443, MS-743, MS-043 and MS-843 (commercial products of Daikin Co.), Asahiguard AG-530, AG-533(S), AG-550, AG-650, AG-710, AG-730, AG-740, AG-780 and AG-800 (commercial products of Asahi Glass Co.), and Elasgand 100 (commercial product of Daiichi Kogyo Seiyaku Co.).

The thermal transfer dye-providing material and the thermal transfer image-receiving material of the present invention may contain a mat agent. Examples of usable mat agents include silicon dioxide; compounds described in JP-A-61-88356 (page 29), such as polyolefins and polymethacrylates; and compounds described in Japanese Patent Application Nos. 62-110064 and 62-110065 (corresponding to JP-A-63-274944 and JP-A-63-274952, respectively), such as benzoguanamine resin beads, polycarbonate resin beads and AS resin beads.

In carrying out the present invention, the thermal transfer dye-providing material and the thermal transfer image-receiving material are interposed on each other and heat energy is imparted in accordance with the image information to be transferred, preferably to the back surface of the thermal transfer dye-providing material, by any heating means, for example, using a thermal head or the like. Thus, the dye in the dye-providing layer is transferred to the thermal transfer image-receiving material in accordance with the strength of the imparted heat energy to give a color image having gradation with excellent sharpness and resolution.

The heating means employable in the process is not limited to only a thermal head but can include any other known means such as laser rays (e.g., semiconductor lasers), infrared flashes and thermal pens may also be used.

In accordance with the present invention, the thermal transfer dye-providing material and the thermal transfer image receiving material are combined to give various prints and facsimile prints with various thermal printers, as well as other various image prints by magnetic recording, photomagnetic recording or optical recording, and also image prints from television or CRT screens.

The details of the thermal transfer recording process applicable to the present invention are described in JP-A-60-34898 (corresponding to U.S. Pat. No. 4,555,427).

The present invention will be explained in more detail by way of the following examples, which, however, are not intended to restrict the scope of the present invention.

EXAMPLE 1

Preparation of Thermal Transfer Dye-Providing Material Sample

A 5.5 μm polyethylene terephthalate film (Lumilar, commercial product by Toray Co.), one surface of which was coated with a heat-resistant slip layer made of a thermosetting acrylic resin, was used as a support. A thermal transfer dye-providing layer composition comprising the components mentioned below was coated on the surface opposite to that previously coated with the heat-resistant slip layer, by wire bar coating, in a dry thickness of 2 μm. After drying, a thermal transfer dye-providing material sample was obtained.

Thermal Transfer Dye-Providing Layer Composition

| | |
|---|---|
| Disperse Dye (a) | 4 g |

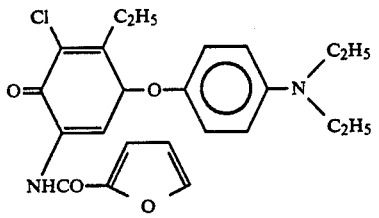

| | |
|---|---|
| Polyvinyl Butyral Resin (Denkabutyral 5000-A, commercial product by Denki Kagaku Co.) | 4 g |
| Methyl Ethyl Ketone | 40 ml |
| Toluene | 40 ml |
| Polyisocyanate (Takenate D110N, commercial product by Takeda Chemical Industries Co.) | 0.2 ml |

Preparation of Thermal Transfer Image-Receiving Material Samples 1-(1) to 1-(6)

A 150 μm synthetic paper (YUPO-FPG-150, commercial product by Oji Yuka Goseishi Co., Ltd.) was used as a support. An image-receiving layer composition comprising the components mentioned below was coated on the surface of the support by wire bar coating in a dry thickness of 10 μm to prepare thermal transfer image-receiving material samples 1-(1) to 1-(6). Drying was effected with a drier for pre-drying and then in an oven having a temperature of 100° C. for 30 minutes.

Thermal Transfer Image-Receiving Layer Composition

| | |
|---|---|
| Resin 1, 3, 34, 39, 23 or 28 (shown in Tables 1, 3 or 4) | 20 g |
| Amino-modified Silicone Oil (KF-857, commercial product by Shin-Etsu Silicone Co.) | 1 g |
| Polyisocyanate (KP-90, commercial product by Dai-Nippon Ink Co.) | 3 g |
| Methyl Ethyl Ketone | 85 ml |
| Toluene | 85 ml |

EXAMPLE 2

The same thermal transfer dye-providing material sample as that in Example 1 was used.

Preparation of Thermal Transfer Image-Receiving Material Samples 2-(1) to 2-(6)

A resin-coated paper was prepared by laminating 32 μm-polyethylene and 20 μm-polyethylene on both surfaces of a 150 μm paper. The same image-receiving layer composition as that used in Example 1 was coated on the 32 μm-polyethylene laminated surface of the paper by wire bar coating in a dry thickness of 10 μm to prepare thermal transfer image-receiving material samples 2-(1) to 2-(6). Drying of the samples was effected in the same manner as in Example 1.

EXAMPLE 3

The same thermal transfer dye-providing material sample as that in Example 1 was used.

Preparation of Thermal Transfer Image-Receiving Material Samples 3-(1) to 3-(6)

A 150 μm synthetic paper (YUPO-FPG-150, commercial product by Oji Yuka Goseishi Co., Ltd.) was used as a support. The surface of the support was coated with an image-receiving layer composition comprising the components mentioned below, by wire bar coating, in a dry thickness of 10 μm to prepare thermal transfer image-receiving material samples 3-(1) to 3-(6). Drying was effected with a drier for pre-drying and then in an oven having a temperature of 100° C. for 30 minutes.

Thermal Transfer Image-Receiving Layer Composition

| | |
|---|---|
| Resin 1, 3, 34, 39, 23 or 28 (shown in Table 1, 3 or 4) | 10 g |
| Polyester Resin (Vylon 200, commercial product by Toyo Spinning Co.) | 10 g |
| Amino-modified Silicone Oil (KF-857, commercial product by Shin-Etsu Silicone Co.) | 1 g |
| Polyisocyanate (KP-90, commercial product by Dai-Nippon Ink Co.) | 3 g |
| Methyl Ethyl Ketone | 85 ml |
| Toluene | 85 ml |

COMPARATIVE EXAMPLE 1

The same thermal transfer dye-providing material sample as that in Example 1 was used.

Preparation of Thermal Transfer Image-Receiving Material Sample 4

An image-receiving layer composition comprising the components mentioned below was coated on the surface of the same support as that used in Example 1, by wire bar coating, in a dry thickness of 10 μm to prepare thermal transfer image-receiving material sample 4. Drying was effected in the same manner as in Example 1.

Thermal Transfer Image-Receiving Layer Composition

| | |
|---|---|
| Polyester Resin (Vylon 200, commercial product by Toyo Spinning Co.) | 20 g |
| Amino-modified Silicone Oil (KF-857, commercial product by Shin-Etsu Silicone Co.) | 1 g |
| Polyisocyanate (KP-90, commercial product by Dai-Nippon Ink Co.) | 3 g |
| Methyl Ethyl Ketone | 85 ml |
| Toluene | 85 ml |

COMPARATIVE EXAMPLE 2

The same thermal transfer dye-providing material sample as that in Example 1 was used.

Preparation of Thermal Transfer Image-Receiving Material Sample 5

The same image-receiving layer composition as that used in Comparative Example 1 was coated on the surface of the same support as that used in Example 2, by wire bar coating, in a dry thickness of 10 μm to prepare thermal transfer image-receiving material sample 5. Drying was effected in the same manner as in Example 1.

COMPARATIVE EXAMPLE 3

The same thermal transfer dye-providing material sample as that in Example 1 was used.

Preparation of Thermal Transfer Image-Receiving Material Sample 6

An image-receiving layer composition comprising the components mentioned below was coated on the surface of the same support as that used in Example 1, by wire bar coating, in a dry thickness of 10 μm to prepare thermal transfer image-receiving material sample 6. Drying was effected in the same manner as in Example 1.

Thermal Transfer Image-Receiving Layer Composition

| | |
|---|---|
| Polyester Resin (Vylon 200, commercial product by Toyo Spinning Co.) | 15 g |
| HQG | 5 g |
| Amino-modified Silicone Oil (KF-857, commercial product by Shin-Etsu Silicone Co.) | 1 g |
| Polyisocyanate (KP-90, commercial product by Dai-Nippon Ink Co.) | 3 g |
| Methyl Ethyl Ketone | 85 ml |
| Toluene | 85 ml |

The thermal transfer dye-providing material sample and each of the thermal transfer image-receiving materials thus prepared were interposed on each other with the dye-providing layer of the former facing the image-receiving layer of the latter, and a thermal head was applied to the side of the support of the thermal transfer dye-providing material sample to effect printing. As the printing conditions, the output power of the thermal head was 0.25 W/dot, the pulse width was from 0.15 to 15 msec, and the dot density was 6 dots/mm. Accordingly, a magenta color image was printed on the image receiving layer of the thermal transfer image receiving material sample.

The reflection density of the area (Dmax) having a saturated color density of the recorded material sample was measured with a Status A Filter. The image formed was stored for one week under irradiation of a fluorescent tester of 12000 lux thereto, whereupon the value of the reflection density of the Dmax area of the thus irradiated sample was measured. Evaluation of the light fastness of the tested sample was effected on the basis of the percentage of the reflection density of the Dmax area of the irradiated sample to that of the Dmax area of the non-irradiated sample.

Next, the image formed was stored under the condition of 80° C. for 72 hours, and the image thus stored was checked and compared with the non-stored image, with respect to the high temperature storage stability of the tested sample. Evaluation of the high temperature storage stability of each sample was effected by a three-rank evaluation and is shown in Table 6. The mark "○" means that the image of the stored sample was not blurred as compared with the non-stored image, the mark "Δ" means that the image of the stored sample was somewhat blurred as compared with the non-stored image, and the mark "×" means that the image of the stored sample was noticeably blurred as compared with the non-stored image.

TABLE 6

| Image-Receiving Material Sample | Resin(s) | Reflection Density | Light Fastness | Blur of Image |
|---|---|---|---|---|
| 1-① | 1 (sample of the invention) | 1.8 | 89 | ○ |
| 1-② | 3 (sample of the invention) | 1.6 | 88 | ○ |
| 1-③ | 34 (sample of the invention) | 2.0 | 91 | ○ |
| 1-④ | 39 (sample of the invention) | 1.8 | 90 | ○ |
| 1-⑤ | 23 (sample of the invention) | 1.7 | 92 | ○ |
| 1-⑥ | 28 (sample of the invention) | 1.5 | 90 | ○ |
| 2-① | 1 (sample of the invention) | 1.6 | 88 | ○ |
| 2-② | 3 (sample of the invention) | 1.4 | 87 | ○ |
| 2-③ | 34 (sample of the invention) | 1.9 | 89 | ○ |
| 2-④ | 39 (sample of the invention) | 1.6 | 90 | ○ |
| 2-⑤ | 23 (sample of the invention) | 1.5 | 91 | ○ |
| 2-⑥ | 28 (sample of the invention) | 1.3 | 89 | ○ |
| 3-① | 1 (sample of the invention) + Vylon 200 | 1.6 | 87 | ○ |
| 3-② | 3 (sample of the invention) + Vylon 200 | 1.4 | 86 | ○ |
| 3-③ | 34 (sample of the invention) + Vylon 200 | 1.8 | 88 | ○ |
| 3-④ | 39 (sample of the invention) + Vylon 200 | 1.6 | 87 | ○ |
| 3-⑤ | 23 (sample of the invention) + Vylon 200 | 1.5 | 89 | ○ |
| 3-⑥ | 28 (sample of the invention) + Vylon 200 | 1.3 | 87 | ○ |
| 4 | Vylon 200 (comparative sample 1) | 1.6 | 79 | ○ |
| 5 | Vylon 200 (comparative sample 2) | 1.5 | 77 | ○ |
| 6 | HQG + Vylon 200 (comparative sample 3) | 1.6 | 81 | x |

In accordance with the present invention, a thermal transfer image-receiving material capable of forming an image having a high image density and excellent storage stability may be obtained due to incorporation of a particular thermoplastic resin into the image-receiving layer. The thermoplastic resin in the layer in the materials of the present invention had no harmful influence on the initial image density (reflection density) or on the storage stability (i.e., blurring and light fastness) of the image formed.

While the invention has been described in detail and with reference to specific embodiments thereof, it will be apparent to one skilled in the art that various changes and modifications can be made therein without departing from the spirit and scope thereof.

What is claimed is:

1. A thermal transfer image-receiving material having an image-receiving layer comprising a thermoplastic resin capable of receiving a dye, on a support, wherein the thermoplastic resin is a polyester obtained by polycondensation of monomers represented by formula (1), (2), (3) and (4) of monomers represented by formula (1), (2), (5) and (6):

$$HO\text{-}(A_1)\text{-}OH \quad (1)$$

$$B_1OOC\text{-}(A_2)\text{-}COOB_2 \quad (2)$$

$$HO\text{-}(A_3)\text{-}OH \quad (3)$$
$$\quad\quad |$$
$$\quad (L_1\text{-}M_1)_a$$

$$B_3OOC\text{-}(A_4)\text{-}COOB_4 \quad (4)$$
$$\quad\quad |$$
$$\quad (L_2\text{-}M_2)_b$$

$$HO\text{-}(M_3)\text{-}OH \quad (5)$$

$$B_5OOC\text{-}(M_4)\text{-}COOB_6 \quad (6)$$

where $A_1$ and $A_2$ each represents a substituted or unsubstituted alkylene, arylene or cycloalkylene group having from 1 to 18 carbon atoms and may be the same or different;

$A_3$ and $A_4$ each represents a substituted or unsubstituted alkylene or arylene group having from 1 to 18 carbon atoms and may be the same or different;

$B_1$, $B_2$, $B_3$, $B_5$ and $B_4$ each represents a hydrogen atom or a substituted or unsubstituted alkyl group having from 1 to 8 carbon atoms and may be the same or different;

$L_1$ and $L_2$ each represents a linking group capable of bonding adjacent groups via a bonding group of ether, ester, amido or urethane and may be the same or different;

a and b each represents 1 or 2 and may be the same or different, $M_1$ and $M_2$ each represents an anti-fading group of formula (7) and may be the same or different:

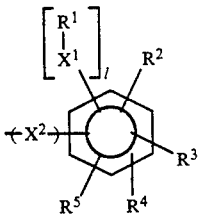

(7)

wherein $R^1$ represents a hydrogen atom, or a substituted or unsubstituted alkyl, alkenyl, aryl, heterocyclic or silyl group having from 1 to 21 carbon atoms; and if l is more than 1, the more than one $R^1$'s may be same or different from each other;

$X^1$ represents —O—, —S— or =N—$R^{(1)}$ wherein $R^{(1)}$ is a hydrogen atom or a substituted or unsubstituted alkyl or aryl group having up to 18 carbon atoms;

when $X^1$ is —O— and $R^1$ is an alkyl group, then if two adjacent —$OR^1$ groups are present, the two adjacent —$OR^1$ groups may be bonded to each other to form a methylene or ethylene group;

$X^2$ represents a bonding group of ether, ester, amido or urethane;

l represents a number from 1 to 3; and $R^2$, $R^3$, $R^4$ and $R^5$ each represents a hydrogen atom, an organic residue or $[R^1\text{—}X^1]$ wherein $R^1$ and $X^1$ have the same meaning as those described above, and may be the same or different; and $M_3$ and $M_4$ each represents an anti-fading group of formula (8) and may be the same or different;

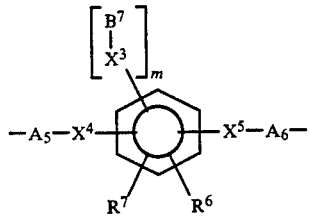

(8)

wherein $B^7$ represents a hydrogen atom, or a substituted or unsubstituted alkyl, alkenyl, aryl, heterocyclic or silyl group having from 1 to 18 carbon atoms; and if m is more than 1, the more than one $B^7$'s may be same or different from each other;

m represents 1 or 2;

$X^3$, $X^4$ and $X^5$, which maybe the same or different, each represents —O—, —S— or =N—$B^8$ wherein $B^8$ is a hydrogen atom or an alkyl or aryl group having up to 18 carbon atoms;

$A_5$ and $A_6$ each represents a linking group may be the same or different; and $R^6$ and $R^7$ each represents a hydrogen atom or an organic residue and maybe the same or different, and wherein the monomers containing the anti-fading groups are present in the thermoplastic resin in an amount of 1 mol % or more of the total monomers constituting the thermoplastic resin.

2. The thermal transfer image-receiving material of claim 1, wherein $A_1$ is an alkylene or cycloalkylene group of formula (9) to (12):

$$(CH_2)_d\text{-}(C^{R^{(2)}}_{R^{(2)'}})_e\text{-}(CH_2)_f \quad (9)$$

wherein $R^{(2)}$ and $R^{(2)'}$, which may be the same or different, each represents a substituted or unsubstituted alkyl group having from 1 to 6 carbon atoms; and d, e and f, which may be the same or different, each represents a number of from 0 to 20, provided that $d+e+f>2$.

$$(CH^{R^{(3)}}_{|}CH_2O)_{d'}\text{-}CH^{R^{(3)'}}_{|}CH_2\text{—} \quad (10)$$

wherein $R^{(3)}$ and $R^{(3)'}$, which may be the same or different, each represents a hydrogen atom or a methyl group; and d' represents a number from 1 to 10,

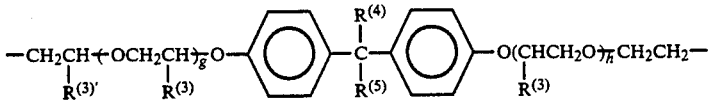

(11)

wherein $R^{(3)}$ and $R^{(3)'}$, which may be the same or different, each represents a hydrogen atom or a methyl group; $R^{(4)}$ and $R^{(5)}$, which maybe the same or different, each represents a substituted or unsubstituted alkyl group having from 1 to 6 carbon atoms; and g and h, which may be the same or different, each represents a number from 0 to 7,

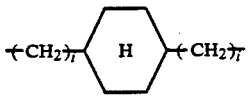

(12)

wherein i represents a number from 1 to 6.

3. The thermal transfer image-receiving material of claim 1, wherein $A_1$ is an arylene group of formulae (13) and (14):

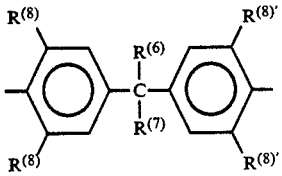

(13)

wherein $R^{(6)}$, $R^{(7)}$, $R^{(8)}$ and $R^{(8)'}$, which maybe the same or different, each represents a hydrogen atom, or a substituted or unsubstituted alkyl group having from 1 to 6 carbon atoms,

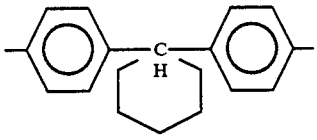

(14)

4. The thermal transfer image-receiving material of claim 1, wherein ($A_3$) and $L_1$ are bonded to each other to form a group represented by formulae (16) and (17):

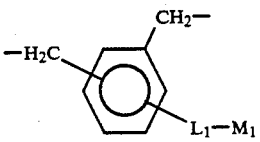

(16)

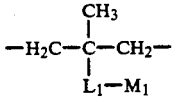

(17)

wherein $-L_1-M_1$ represents $-O-R^{(9)}-M_1(M_2)$, $-COOR^{(10)}-M_1(M_2)$, $-CON(R^{(11)})-R^{(12)}-M_1(M_2)$, $-SO_2-N(R^{(11)})-R^{(13)}-M_1(M_2)$, or $-OOCH-R^{(14)}-M_1(M_2)$;

$R^{(9)}$, $R^{(10)}$, $R^{(12)}$, $R^{(13)}$ and $R^{(14)}$, which may be the same or different, each represents a substituted or unsubstituted alkylene group having from 2 to 10 carbon atoms; and $R^{(11)}$ represents a hydrogen atom or an alkyl group having from 1 to 6 carbon atoms.

5. The thermal transfer image-receiving material of claim 1, wherein ($A_4$) and $L_2$ are bonded to each other to form a group represented by formula (18):

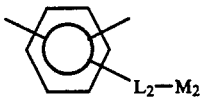

(18)

wherein $-L_2-M_2$ represents $-O-R^{(9)}-M_1(M_2)$, $-COOR^{(10)}-M_1(M_2)$, $-CON(R^{(11)})-R^{(12)}-M_1(M_2)$, $-SO_2-N(R^{(11)})-R^{(13)}-M^1(M_2)$, or $-OOCNH-R^{(14)}-M_1(M_2)$;

$R^{(9)}$, $R^{(10)}$, $R^{(12)}$, $R^{(13)}$ and $R^{(14)}$, which may be the same or different, each represents a substituted or unsubstituted alkylene group having from 2 to 10 carbon atoms; and $R^{(11)}$ represents a hydrogen atom or an alkyl group having from 1 to 6 carbon atoms.

6. The thermal transfer image-receiving material of claim 1, wherein the thermoplastic resin comprises the monomers of formulae (1), (2), (3) and (4) or (1), (2), (5) and (6) in an amount of about 1% or more based on the total amount of monomers in the resin.

7. The thermal transfer image-receiving material of claim 6, wherein the amount of monomers represented by formulae (1)+(3) or (1)+(5) in the thermoplastic resin is 50 mol % and the amount of the monomers represented by formulae (2)+(4) or (2)+(6) in the thermoplastic resin is 50 mol %.

8. The thermal transfer image-receiving material of claim 6, wherein the amount of at least one of the monomers of formulae (3), (4), (5) and (6) is 5 mol % or more based on the total amount of monomers in the resin.

9. The thermal transfer image-receiving material of claim 6, wherein the amount of the monomers of formulae (3) and (4) or formulae (5) and (6) is within the range of from 0 to 50 mol %, and the sum of the monomers of formulae (3) and (4) or formulae (5) and (6) is within the range of from 5 to 50 mol % based on the total amount of the monomers in the resin.

10. The thermal transfer image-receiving material of claim 6, wherein the amount is from 5% to 50%.

11. The thermal transfer image-receiving material of claim 1, wherein $R^2$, $R^3$, $R^4$and $R^5$each represents an alkyl group having 1 to 8 carbon atoms or an alkyl group substituted by chlorine or bromine.

12. The thermal transfer image-receiving material of claim 1, wherein $R^6$ and $R^7$ each represents an alkyl group having 1 to 8 carbon atoms or an alkyl group substituted by chlorine or bromine.

13. The thermal transfer image-receiving material of claim 1, wherein $A_5$ and $A_6$, which may be the same or different, each represents an alkylene group having from 2 to 18 carbon atoms.

14. The thermal transfer image-receiving material of claim 1, wherein $A_2$ is an alkylene, cycloalkylene and arylene group of formulae (15a) to (15d):

$$-(CH_2)_j- \quad (15a)$$

where j is a number from 2 to 18, (15b)

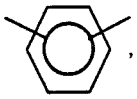

, (15c)

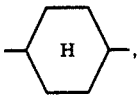

, and

-continued (15d)

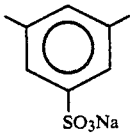

15. The thermal transfer image-receiving material of claim 1, wherein the thermal transfer image-receiving material comprises a thermal solvent or a high boiling point organic solvent in the image-receiving layer.

16. The thermal transfer image-receiving material of claim 15, wherein the thermal solvent or the high boiling organic solvent is present singly in the image-receiving layer in the form of a microdispersion or in the image-receiving layer as a mixture with a dye-receiving polymer.

17. The thermal transfer image-receiving material of claim 1, wherein the thickness of the image-receiving layer is from 0.5 to 50 μm.

18. The thermal transfer image-receiving material of claim 17, wherein the thickness is from 3 to 30 μm.

* * * * *